US006284421B1

(12) United States Patent
Matsuzaki et al.

(10) Patent No.: US 6,284,421 B1
(45) Date of Patent: Sep. 4, 2001

(54) CARRIER FOR ELECTROPHOTOGRAPHY, PROCESS FOR PRODUCTION OF THE CARRIER AND DEVELOPING AGENT FOR ELECTROPHOTOGRAPHY USING THE CARRIER

(75) Inventors: Shigeo Matsuzaki, Sodegaura; Yuji Kamiyama; Hisashi Mukataka, both of Watarai-gun, all of (JP)

(73) Assignees: Idemitsu Kosan Co., Ltd., Tokyo; Kyocera Corporation, Kyoto, both of (JP)

( * ) Notice: Subject to any disclaimer, the term of this patent is extended or adjusted under 35 U.S.C. 154(b) by 0 days.

(21) Appl. No.: 09/460,110

(22) Filed: Dec. 13, 1999

(30) Foreign Application Priority Data

Dec. 28, 1998 (JP) ..... 10-377416

(51) Int. Cl.[7] ..... G03G 9/113
(52) U.S. Cl. ..... 430/106.6; 430/108
(58) Field of Search ..... 430/108, 106.6

(56) References Cited

U.S. PATENT DOCUMENTS 5,272,037 * 12/1993 Ohtani et al. ..... 430/108
5,766,814 * 6/1998 Baba et al. ..... 430/108
5,968,699 10/1999 Matsuzaki et al. .
6,083,652 * 7/2000 Duggan et al. ..... 430/108

* cited by examiner

*Primary Examiner*—Christopher Rodee
(74) *Attorney, Agent, or Firm*—Oblon, Spivak, McClelland, Maier & Neustadt, P.C.

(57) ABSTRACT

An electrophotographic carrier, which has high charging characteristics and an excellent durability, does not dull a color image and has an excellent moisture resistance is provided. A process for the production of the carrier and a developing agent for electrophotography using the carrier are also provided. The electrophotographic carrier comprises a carrier core material provided with magnetism and a coating layer formed on the surface of the carrier core material, the coating layer containing at least a hydrophobic white conductive material and a high molecular weight polyethylene resin.

8 Claims, 10 Drawing Sheets

CARRIER FOR ELECTROPHOTOGRAPHY, PROCESS FOR PRODUCTION OF THE CARRIER AND DEVELOPING AGENT FOR ELECTROPHOTOGRAPHY USING THE CARRIER

Technical Field

The present invention relates to a carrier for electrophotography (simply called "carrier" or "electrophotographic carrier" as the case may be), a process for the production of the carrier and a developing agent for electrophotography using the carrier. More particularly, the present invention relates to a carrier for electrophotography used to develop an electrostatic latent image in a method for forming an image by making use of electrophotography, a process for the production of the carrier and a developing agent for electrophotography using the carrier.

BACKGROUND OF THE INVENTION

As an electrostatic latent image development for electrophotography, an one-component magnetic jumping development, an one-component non-magnetic contacting development, and a two-component development, in which development is performed by frictionally electrifying a toner, transporting a developer, and contacting with an electrostatic latent image, by mixing an insulating non-magnetic toner and magnetic carrier particles, are known so far.

Particularly attention has been paid gain to application of the two-component development to the color printer as a promising method in near future.

A particulate carrier, which is used in such two-component development, is usually produced by coating a magnetic carrier core material with an appropriate material in order to prevent from a toner-filming onto the surface of the carrier, to form a carrier-uniform surface, to elongate the lifetime of a developer, to prevent damage of a sensitizer by a carrier, to control charge quantity, or for other purposes.

Conventional resin-coated carriers are not, however, satisfactory in durability because the coat is easily exfoliated by an impact such as stirring applied when used or for other reasons.

On the other hand, as methods to solve the above-mentioned problems, a method to improve charge quantity by containing nigrosin in a carrier-coated resin is disclosed in Japanese Patent Laid-open Pub. No. Sho 53-100242, a method to improve fluidity by adding a fluidity-improving agent is disclosed in Japanese Patent Laid-open Pub. No. Sho 61-9661, and a method to prevent making the charging property uniform and being spent by adding one selected from a group consisting of electroconductive fine particles, inorganic filler particles, and a charge-controlling agent, is disclosed in Japanese Patent Laid-open Pub. No. Hei. 2-210365.

These methods, however, could not satisfy providing the carrier having both the good controlling charging characteristics (controlling charge polarity, adjusting charge quantity, and adjusting resistance), and the good durability by preventing external additives of a toner from being spent.

In view of the above situation, the inventors of the present invention have proposed to bury convex polyhedron magnetic particles or carbon black in the outermost layer of an electrophotographic carrier which is coated with a high molecular weight polyethylene resin obtained by a direct polymerization process as disclosed in Japanese Patent Laid-open Pub. No. Hei 10-171168, thereby providing an electrophotographic carrier which is well-balanced between charging characteristics and durability.

However, when such an electrophotographic carrier is used in applications as color printers, there is the case where magnetic powders or carbon black which are imperfectly buried are fallen off. As a result, this opens up the problem that there is the case of forming a dull color image.

While, Japanese Patent Laid-open Pub. No. Hei 9-54461 discloses a process for producing an electrophotographic carrier, the process being characterized in that conductive fine particles having a whiteness of 0.2 or less and a volumetric specific resistance of $1\times10^2$ to $1\times10^{11}$ Ω·cm is added to a coating resin of an electrophotographic carrier when a polyolefin type resin is polymerized.

However, when the electrophotographic carrier obtained in such a production process is used at high temperature and high humidity for a long period of time, such a phenomenon is found that the conductive fine particles absorb water to decrease charge quantity.

The present invention has been made in view of the above problems and has an object of providing an electrophotographic carrier having the following characteristics, making use of excellent qualities of a carrier provided with a polyolefin in type resin coating.

i) The control of its charge quantity and the adjustment of its resistance can be respectively made at will.

ii) It prevents external additives for a toner from being spent and hence has an excellent durability.

iii) It scarcely causes the resultant color image to be dull even if it is used for a color developer.

iv) It has an excellent moisture resistance.

Another object of the present invention is to provide a process for producing the aforementioned electrophotographic carrier in an efficient manner.

A further object of the present invention is to provide a developing agent for electrophotography using the aforementioned electrophotographic carrier.

DISCLOSURE OF THE INVENTION

An electrophotographic carrier according to the present invention comprises a magnetic carrier core material and a coating layer formed on the surface of the carrier core material, wherein the coating layer contains at least a high molecular weight polyethylene resin and a hydrophobic white conductive material.

Such a structure as described above makes it possible to provide an electrophotographic carrier which is well-balanced between charging characteristics and durability, does not dull a color image even if it is used for a color electrophotographic developer and has a high moisture resistance.

In a modified structure of the electrophotographic carrier of the present invention, preferably the visual luminosity (L value) of a white conductive material which is measured by a reflectometer is about 78 or more.

In this structure, an electrophotographic carrier can be provided which is more reduced in the dulling of the resultant color image even if it is used for a color developer. Specifically, the visual luminosity (L value) was designed to fall in the above range based on the finding of the fact that there is a high relationship between the visual luminosity (L value) of the white conductive material and the turbidity of a color, of which a man feels, in a color image.

In a modified structure of the electrophotographic carrier of the present invention, preferably the ratio Q1/Q2 is designed to be about 0.75 or more provided that the water content of the carrier after it is allowed to stand at a temperature of 20° C. and a humidity of 50% for 48 hours is designated as Q1 and the water content after it is allowed to stand at a temperature of 50° C. and a humidity of 90% for 48 hours is designated as Q2.

In this structure, higher moisture resistance is obtained, making it possible to accord in advance with a variation in charge quantity in a working field.

In a modified structure of the electrophotographic carrier of the present invention, preferably a hydrophobic white conductive material differing from the hydrophobic white conductive material contained in the coating layer and a hydrophilic white conductive material or either one of these white conductive materials is filled in a concave portion formed in the coating layer.

Specifically, an electrophotographic carrier is provided in which a hydrophobic or non-hydrophobic white conductive material (called "second white conductive material" as the case may be) differing from the hydrophobic white conductive material (called "first white conductive material" as the case may be) contained in the coating layer is present locally in the concave portion of coating layer with the high molecular weight polyethylene resin.

In this structure, the second white conductive material resultantly exists in a manner that it is distributed in the direction of the thickness (in the direction of the depth) of the carrier and functions mutually with the first white conductive material contained in the coating layer with the result that more excellent charging characteristics can be obtained. Also, because the second white conductive material is filled in the concave portion formed in the coating layer, it hardly falls off and, further, scarcely absorbs the ambient water.

In a modified structure of the electrophotographic carrier of the present invention, preferably a hydrophobic white conductive material differing from the hydrophobic white conductive material contained in the coating layer and a hydrophilic white conductive material or either one of these white conductive materials is formed within (inside) the coating layer.

Specifically, a conductive layer in which a white conductive material (called "third white conductive material" as the case may be) differing from the hydrophobic white conductive material (called "first white conductive material" as the case may be) contained in the coating layer exists in a large amount is formed in a range from the surface to a depth of 1 $\mu$m in the coating layer with the high molecular weight polyethylene resin.

In this structure, the third white conductive material resultantly exists in a manner that it is distributed in the direction of the thickness (in the direction of the depth) of the carrier and functions mutually with the first white conductive material contained in the coating layer with the result that more excellent charging characteristics can be obtained. Also, because the third white conductive material is fully embedded in the coating layer, it hardly falls off, further, scarcely absorbs the ambient water resultantly.

According to another aspect of the present invention, there is provided a process for producing an electrophotographic carrier comprising a carrier core material provided with magnetism and a coating layer formed on the surface of the carrier core material. The production process of the present invention comprises a first step of coating the surface of a carrier core material with a high molecular weight polyethylene resin by a direct polymerization method, and a second step of introducing a hydrophobic white conductive material into the high molecular weight polyethylene resin by using a mechanical impact.

Such a process as above makes it possible to provide an electrophotographic carrier which is well-balanced between charging characteristics and durability, does not dull a color image even if it is used for a color electrophotographic developer and has high moisture resistance in an efficient manner.

In a modification of the process for producing the electrophotographic carrier of the present invention, preferably, in the first step, a hydrophobic white conductive material differing from the hydrophobic white conductive material used in the second step and a hydrophilic white conductive material or either one of these white conductive materials is added while coating with a high molecular weight polyethylene resin.

In this modification, when the white conductive material is introduced into the high molecular weight polyethylene resin, it can be filled uniformly and firmly. Moreover, compared with the case of adding all white conductive materials by using a mechanical impact or the like, the production time can be shortened as a whole.

In another modification of the process for producing the electrophotographic carrier of the present invention, preferably, in the first step, after by using a carrier core material having a concave portion on the surface thereof, a polymerization catalyst is carried in the concave portion, the core material is coated with the high molecular weight polyethylene resin obtained by direct polymerization.

In this modification, the polymerization catalyst never falls off from the carrier core material and the carrier core material can be coated firmly with the high molecular weight polyethylene resin. Also, the use of such a carrier core material having a concave portion on the surface thereof allows a ethylene monomer to polymerize along the configuration of the concave portion, making it possible to form a concave portion with ease in the coating layer. Accordingly, the white conductive material can be filled in the concave portion by utilizing such a concave portion and hence an electrophotographic carrier having superior conductive characteristics can be efficiently obtained.

In a further modification of the process for producing the electrophotographic carrier of the present invention, preferably, the process comprises, prior to the second step, a step of filling a hydrophobic white conductive material differing from the hydrophobic white conductive material used in the second step and a hydrophilic white conductive material or either one of these white conductive materials in the concave portion formed in the coating layer.

In this modification, a different white conductive material (called "second white conductive material" as the case may be) besides the hydrophobic white conductive material (called "first white conductive material" as the case may be) added to the coating layer in the second step exists in a manner that it is distributed in the direction of the thickness of the electrophotographic carrier. Hence, the second white conductive material functions mutually with the first white conductive material contained in the coating layer with the result that an electrophotographic carrier having more excellent charging characteristics in the entire of the electrophotographic carrier can be obtained efficiently.

In a still further modification of the process for producing the electrophotographic carrier of the present invention, preferably, the process comprises, prior to the second step, a step of adding a hydrophobic white conductive material and a hydrophilic white conductive material or either one of these white conductive materials (one or both of these white conductive materials are collectively called "third white conductive material" as the case may be) in the high molecular weight polyethylene resin besides the hydrophobic white conductive material used in the second step to form a conductive layer.

In this modification, the third white conductive material exists in a manner that it is distributed also in the direction of the thickness of the electrophotographic carrier. Hence, the third white conductive material functions mutually with the first white conductive material contained in the coating layer with the result that an electrophotographic carrier having more excellent charging characteristics in the entire of the electrophotographic carrier can be obtained efficiently.

According to a further aspect of the present invention, there is provided a developing agent for electrophotography comprising the aforementioned carrier and a toner wherein the amount of the toner to be mixed is designed to be in a range of 2 to 40% by weight for the total amount of the carrier and the toner.

In this structure, a developing agent can be provided which has high charging characteristics and conductive characteristics and excellent durability, does not dull a color image even if it is used in a color printer or the like and has high moisture resistance.

PREFERRED EMBODIMENTS OF THE INVENTION

A carrier for electrophotography (a first embodiment to a third embodiment), a process for producing the carrier for electrophotography (a fourth embodiment and a fifth embodiment) and a developing agent using the carrier for electrophotography (a sixth embodiment) according to the present invention will be hereinafter explained concretely.

(First Embodiment)

Figure 1:
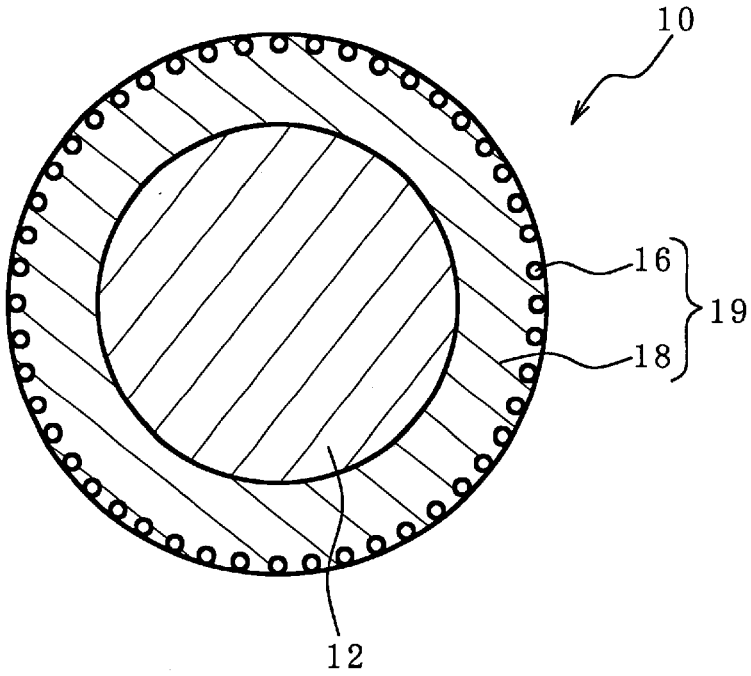
FIG. 1 is a view typically showing a carrier for electrophotography in a first embodiment.

As shown in FIG. 1, the first embodiment of the present invention is an electrophotographic carrier 10 comprising a carrier core material 12 and a coating layer 19 which is made of a high molecular weight polyethylene resin 16 and is overlaid on the surface of the carrier core material 12. The coating layer 19 contains a hydrophobic white conductive material 16. The ratio Q1/Q2 is designed to be about 0.75 or more provided that the water content of the electrophotographic carrier 10 after it is allowed to stand at a temperature of 20° C. and a humidity of 50% for 48 hours is designated as Q1 and the water content after it is allowed to stand at a temperature of 50° C. and a humidity of 90% for 48 hours is designated as Q2. Each structural element will be explained hereinafter concretely.

1. Carrier Core Material (1) Material

There is no particular limitation to the core material of carrier according to the present invention. Well known materials for the two component-system carrier for electrophotography can be used, such as i) ferrite, magnetite, or the like; metals such as iron, nickel, and cobalt, ii) an alloy or a mixture of these metals with a metal such as copper, zinc, antimony, aluminum, lead, tin, bismuth, beryllium, manganese, magnesium, selenium, tungsten, zirconium, and vanadium, iii) a mixture of the above-mentioned ferrite or the like with a metal oxide such as iron oxide, titanium oxide, and magnesium oxide, a nitride such as chromium nitride and vanadium nitride; a carbide such as silicon carbide and tungsten carbide, iv) ferromagnetic ferrite, and v) a mixture of these materials.

(2) Shape and Particle Diameter

No particular restriction is placed on the shape of the carrier core material and any of a globular form, undefined form and the like may be adopted. However, it is desirable to use a carrier core material having irregularities or concave portions on the surface thereof to carry a polymerization catalyst with ease when a coating layer composed of a high molecular weight polyethylene resin explained later is formed.

Also, though no particular limitation is imposed on the average particle diameter of the carrier core material, a carrier core material having an average particle diameter of 8 to 120 μm is desirably used. This is because if the average particle diameter is less than 8 μm, there is the case where adhesion (scattering) of a carrier to an electrostatic latent image supporting carrier (sensitive body in general) is caused when the carrier is formed whereas if the average particle diameter is 120 μm or more, there is the case where carrier streaks and the like are produced when the carrier is formed, resulting in deteriorated image qualities.

(3) Ratio of Formulation

The weight ratio of the carrier core material per the overall carrier is set to 90 wt. % or higher, preferably to 95 wt. % or higher. The weight ratio of the formulation indirectly specify the thickness of the resin-coated layer of the carrier. If the weight ratio is lower than 90 wt. %, the coating layer may become too thick, and the durability and the stability of charge which are required for a developer might not be satisfied because of exfoliation of the coating layer, increase in the charge quantity, and other reasons, even if the carrier is practically applied to a developer. Also it may cause troubles such as low reproducibility in fine lines and decrease in image density with respect to the quality of image. Although there is no particular limitation to the upper limit, such a ratio may be enough that the coated resin layer can completely coat the surface of the carrier core material. This value depends on the physical properties of the carrier core material and the method for coating.

(4) Electroconductive Layer

An electroconductive layer can be formed on the carrier core material particles prior to coating with a high molecular weight polyethylene resin if necessary.

As the electroconductive layer formed on the carrier core material particles, for example, one, in which electroconductive fine particles are dispersed in an appropriate binding resin, is favorable. The formation of such an electroconductive layer is effective in enhancing a developing property and obtaining clear images having high image density and clear contrast. The reason for this is considered that the existence of the electroconductive layer lowers electroresistance of the carrier to a suitable level to balance leak and accumulation of electric charge.

The carrier core material particles on which a functional layer such as an electroconductive layer was formed will also be designated hereafter simply as "carrier core material particles" as long as misunderstanding can be avoided.

Next, each component for adding to an electroconductive layer will be explained.

As the electroconductive fine particle added to the electroconductive layer, the followings can be used: carbon black such as carbon black and acetylene black, carbide such as SiC, magnetic powder such as magnetite, $SnO_2$, and titanium black.

With respect to an average particle size of the electroconductive fine particle, it should be one that allows homogeneous dispersion in the above-mentioned resin solution: concretely 0.01-2 μm, preferably 0.01-1 μm.

With respect to the binding resin of the electroconductive layer, the followings can be used: various thermoplastic resins and thermosetting resins such as polystyrene-based resins, poly(metha)acrylic acid-based resins, polyolefin-based resins, polyamide-based resins, polycarbonate-based resins, polyether-based resins, polysulfonic acid-based resins, polyester-based resins, epoxy-based resins, polybutyral-based resins, urea-based resins, urethane/urea-based resins, silicone-based resins, and Teflon-based (trademark name, polytetrafluoroethylene) resins, and a mixture, a copolymer, a block polymer, a graft polymer, and a polymer blend of these resins.

With respect to the forming way of the electroconductive layer, it is not limited to the special way, but it can be formed by coating a liquid in which the electroconductive fine particles are dispersed in the appropriate binding resin onto the surface of the carrier core material particles by a method such as the spray coating method and the dipping method. In addition, it can also be formed by melting/blending/crushing the core material particles, electroconductive fine particles, and a binding resin. In addition, it can also be formed by polymerizing a polymerizable monomer on the surface of the core material particle in the presence of the electroconductive fine particles.

With respect to the amount of the electroconductive fine particles to be added, it also depends on the kind and other factors. Even if it is not specified, a weight ratio of 0.1–60 wt. % per the binding resin of the electroconductive layer, is preferably in the range of 0.1–40 wt. %.

Although such a trouble occurs that the reproducibility decreases when fine lines are copied repeatedly using a carrier like this when the packing ratio of the carrier is as small as ca. 90 wt. % and the thickness of the coating layer is relatively thick, this kind of trouble can be dissolved by adding the above-mentioned electroconductive fine particles.

2. Coating Layer Comprising a High Molecular Weight Polyethylene Resin (1) High Molecular Weight Polyethylene Resin It is desirable that the molecular weight of the high molecular weight polyethylene resin forming the coating layer be 10,000 or more in terms of number average molecular weight measured by GPC (gel permeation chromatography) and 50,000 or more in terms of weight average molecular weight. This is because if the number average molecular weight is less than 10,000, there is the case where the mechanical strength of the resin is reduced and the coating layer is peeled off from the core material by, for example, shearing force produced in a developing machine when the carrier is used for a long time.

(2) Method for Forming Coating Layer i) Method for Forming

There is no particular limitation to form a coating layer used in the present invention. Although well known methods such as the dipping method, the fluidized bed method, the dry-type method, and the spray dry method can be applied, the following direct polymerization method is preferred to coat the polyethylene-based resin because the resin-coating strength is strong and the coat is not be exfoliated easily.

Here, "the direct polymerization method" is a method to produce a polyethylene resin-coated carrier by treating the surface of the carrier core material with an ethylene-polymerizing catalyst and directly polymerizing ethylene (forming polyethylene) on the surface, as described, for example, in Japanese Patent Laid-open Pub. No. Sho 60-106808 and Japanese Patent Laid-open Pub. No. Hei 2-187770. The polyethylene resin-coated layer can be formed by suspending a product that is obtained in advance by contacting a highly active catalytic component that contains both or either titanium and zirconium ,and is soluble in a hydrocarbon solvent, such as hexane and heptane, with the carrier core material, and an organoaluminum compound in the above-mentioned hydrocarbon solvent, supplying an ethylene monomer, and polymerizing it on the surface of the carrier core material. In addition, in case fine particles or electroconductive fine particles having the above-mentioned an electric charge-conferring function are added, they can be added while the above-mentioned layer coated with high molecular weight polyethylene resin is formed.

As this production forms a polyethylene-coated layer directly on the surface of the carrier core material, a coat excellent in strength and durability is obtained.

If functional fine particles such as electroconductive fine particles and fine particles having an ability to control electric charge are dispersed/coexisted in the polymerization system in this way, while a high-molecular-weight polyethylene resin coat is growing/being formed by polymerization, the functional fine particles are incorporated into this coat, and a high-molecular-weight polyethylene resin coat containing the functional particles is formed.

ii) Amount of Coating

A high-molecular-weight polyethylene resin coat is formed with a weight ratio of [carrier core material] /[high-molecular-weight polyethylene resin coat] being preferably in a range of 99.5/0.5–90/10, more preferably in a range of 99/1–95/5.

Figure 2:
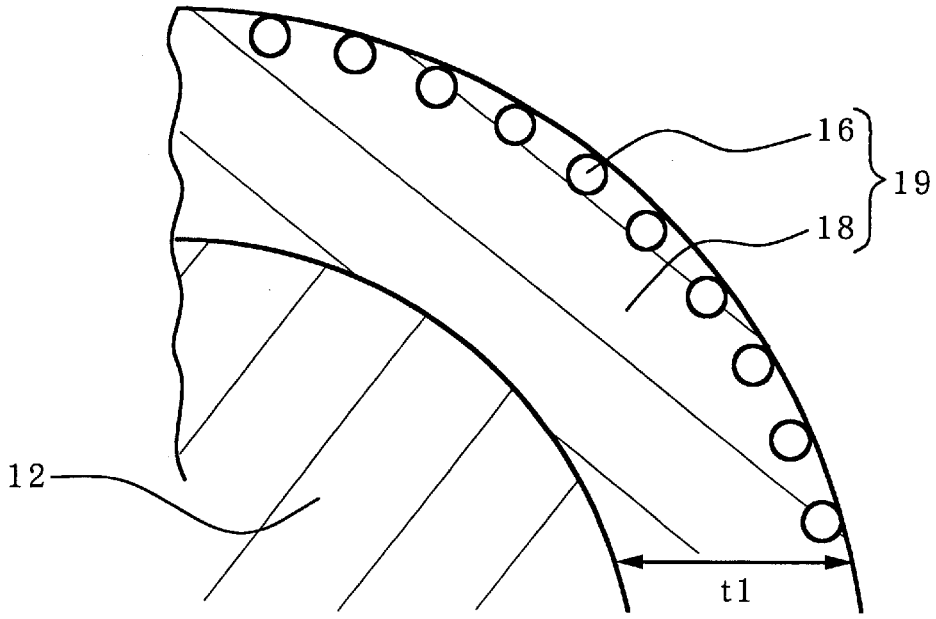
FIG. 2 is an enlarged view of a part of the carrier for electrophotography in the first embodiment.

Also, the thickness of the coating layer is preferably in a range of 0.1 to 6 $\mu$m. This is because if the thickness of the coating layer is less than 0.1 $\mu$m, there is the case where only insufficient coating is obtained whereas if the thickness exceeds 6 $\mu$m, there is the case where the coating resin layer is peeled off from the core material by a mechanical impact, such as friction, applied from the outside. Hence, the thickness of the coating layer is preferably in a range of 0.2 to 5 $\mu$m and more preferably of 0.3 to 3 $\mu$m. Incidentally, the thickness of the coating layer is represented by the symbol "t1" in FIG. 2.

iii) Addition and Carriage of Functional Fine Particles

The coating layer can be reformed as partly mentioned above by adding and carrying one or more types of functional fine particle such as conductive fine particles and fine particles having charging controllability. However, in the case of using as a carrier for a color developer, it is desirable to avoid using colored functional fine particles. Also, when a metal oxide or the like is added, the dispersibility in a solvent must be taken into account.

(3) Hydrophobic White Conductive Material

The coating layer contains at least one hydrophobic white conductive material (first white conductive material). Such a structure betters the moisture resistance and improves even the charging characteristics. Specifically, the use of the hydrophobic white conductive material restrains the occurrence of such a phenomenon that the carrier absorbs water to reduce the charge quantity, even if the carrier is used at high temperatures and high humidities for a long period of time. Since the hydrophobic white conductive material is also one type of charge control agent, the charge quantity is easily controlled. Moreover, because the hydrophobic white conductive material is white, generation of dulling in the resultant color image is reduced.

i) Types of Hydrophobic White Conductive Material

Examples of the type of hydrophobic white conductive material (called "first white conductive material" as the case may be) used for the coating layer include single one compound or combinations of two or more compounds selected from the group consisting of conductive titanium oxide (Sb is doped), conductive zinc white (Sb is doped) and conductive stannic oxide (Sb is doped) which are all hydrophobically treated.

These hydrophobic white conductive materials are discriminated from carbon black, magnetic powders and ITO and the like, which are all coloring conductive materials in the point that these coloring materials are colorants having a visual luminosity (L value) less than 78.

It is preferable to use, among these white conductive materials, white conductive materials having a visual luminosity (L value) of about 78 or more, which luminosity is measured using a reflectometer. It is more preferable to use white conductive materials having a visual luminosity of 80 or more and it is most preferable to use white conductive materials having a visual luminosity of 85 or more.

This is because the use of a white conductive material having such a visual luminosity results in the fact that a change in a color tone of the resultant image and the generation of dulling in the resultant color image are reduced even when conductive materials embedded in the high molecular weight polyethylene coating layer is fallen off in continuous printing. Conversely speaking, if a white conductive material having a visual luminosity less than 78 is used, there is the case where the color tone of an image is significantly changed and a dull image is formed.

The average particle diameter of the hydrophobic white conductive material is preferably in a range of 0.01 to 1 $\mu$m. This is because if the average particle diameter is less than 0.01 $\mu$m, there is the case of giving rise to the problems that, for instance, the production of a white conductive material becomes difficult and the material is coagulated or easily scattered in the atmosphere. On the other hand, if the average particle diameter exceeds lam, there is the case where uniform addition to the coating layer becomes difficult. It is therefore more preferable that the average particle diameter of the hydrophobic white conductive material be in a range of 0.03 to 0.5 $\mu$m.

Preferably the resistance (resistance value of powder) of the hydrophobic white conductive material is designed to be lower than $1\times10^7$ $\Omega\cdot$cm which is measured in the condition of a load of 100 kgf and an application voltage of 100 V. This is because if the resistance exceeds $1\times10^7$ $\Omega\cdot$cm, there is the case where it is difficult to control the resistance of the carrier and no function as the conductive material is attained when it is added. It is therefore more desirable that the resistance of the hydrophobic white material be designed to be lower than $1\times10^5$ $\Omega\cdot$cm.

The hydrophobic white conductive material to be added to the coating layer can be obtained by surface-treating the surface of the white conductive material using a hydrophobic agent, such as a silane coupling agent or silicon oil.

Such a hydrophobic treatment of the surface of the white conductive material efficiently prevents a change in charge quantity, which is caused by a remarkable environmental variation (temperature, humidity). Moreover, the hydrophobic treatment makes it easy to control charging polarity (positive or negative charging) and charge quantity.

Although no particular limitation is imposed on the type of silane coupling agent used as the hydrophobic agent, silane coupling agents having an alkyl group as a functional group and silane coupling agents having an amino group are preferably used. Specific examples of the silane coupling agent include dimethyldimethoxysilane, dimethyldiethoxysilane, diethyldimethoxysilane, diethyldiethoxysilane, trimethylmethoxysilane, trimethyldiethoxysilane, propyltrimethoxysilane, γ-chloropropyltrimethoxysilane, γ-aminopropyltrimethoxysilane, γ-aminopropyltriethoxysilane, γ-aminopropyldimethoxymethylsilane, γ-aminopropyldiethoxysilane, perfluorooctyldiethoxysilane and trifluoromethyldimethoxysilane, which may be used either singly or in combinations of two or more.

As to silicon oil, also any silicon oil may be preferably used although the charging characteristics differ depending upon the type of silicon oil such as fluorine-modified silicon oil and oxygen-containing silicon oil and the like. Specific examples of silicon oil include dimethylsilicon oil, methylhydrogen silicon oil, fluorine-modified silicon oil and amino-modified silicon oil, which may be used either singly or in combinations of two or more.

It is possible to control the charge quantity of the carrier with ease by changing the amount of the hydrophobic agent used to treat the hydrophobic white conductive material. For instance, it is preferable that the hydrophobic agent be added in an amount (100 %) sufficient to fully coat the surface of the white conductive material on the basis of calculation from an area occupied by one molecule of the hydrophobic agent and the surface area of the white conductive material. To explain in more detail, the amount of the hydrophobic agent used in the treatment is in a range of preferably 0.01 to 20 parts by weight, more preferably 0.1 to 10 parts by weight and most preferably 0.5 to 5 parts by weight.

Moreover, as a method of treatment using the hydrophobic agent, a well-known method may be adopted. For instance, preferably the white conductive material and a silane coupling agent or silicon oil are uniformly mixed using a stirrer and thereafter heated at temperatures ranging from 30 to 100° C. It is also preferable to add water for hydrolysis when the white conductive material is mixed with the silane coupling agent and the like. This improves the adhesion between the hydrophobic agent and the white conductive material.

ii) Amount to be Added

Next, the amount of the hydrophobic white conductive material used for the coating layer will be explained. Although there is no particular limitation to the amount to be added, the amount is preferably in a range of 0.1 to 150 % by weight (the amount of the additive for the coating resin) when, for instance, the amount of the high molecular weight polyethylene applied to the carrier is defined as 100 % by weight.

This reason is that if the amount of the hydrophobic white conductive material to be added is less than 0.1 % by weight, there is the case where it is difficult to obtain desired electroconductivity whereas if the amount of the hydrophobic white conductive material to be added exceeds 150 % by weight, there is the case where the white conductive material is uniformly embedded with difficulty and becomes susceptible to the influence of environmental variations and an increase in the amount of the conductive material which is fallen off causes the generation of dulling and a change in the resistance.

Hence, the amount of the hydrophobic conductive material is more preferably in a range of 1 to 120 % by weight and most preferably 10 to 100 % by weight on the basis of 100 % by weight of the high molecular weight polyethylene to be applied.

iii) Method of Adding Hydrophobic White Conductive Material

Next, a discussion will be followed on a method of adding the hydrophobic white conductive material used for the coating layer. Preferably such an addition method is changed according to the object of the hydrophobic white conductive material to be added. Specifically, in the case of adding the hydrophobic white conductive material for the purpose of lowering the resistance, it is preferable to attain the purpose by using any one of the following methods:

a. it is added when the coating layer is formed by polymerization;
b. it is introduced into the inside of the coating layer by a mechanical impact; and
c. it is added collectively in the concave portion present prior to the treatment.

The conditions such as treating time required for the addition differ depending upon the particle diameter, shape and qualities (e.g., hydrophobicity, resistance value and hardness) of the white conductive material to be used. Therefore, an optimum method and condition may be selected corresponding to the white conductive material. Moreover, when the white conductive material is added such that it exist in the vicinity of the surface for the purpose of controlling charge quantity, improving the environmental resistance and restraining charge-up, it is most suitable to add uniformly by a mechanical impact or heat treatment after smoothing treatment.

In the case of performing the addition by a mechanical impact, it is suitable to use a Henshel mixer, for instance, an FM20C/I type manufactured by Mitsui Miike Chemical Machine Co., Ltd.. In the case of performing the addition by heating, it is suitable to use a thermal spheronizing machine, for example, a thermal spheronizing machine manufactured by Hosokawa Micron Co., Ltd..

3. Carrier (1) Average Particle Size

Next, an average particle size of a carrier of a first embodiment will be explained. There is no particular limitation to such a particle size, however, a size of 20–120 μm is preferable. If the size is smaller than 20 μm, attachment (scattering) of the carrier to the electrostatic latent image may occur. If the size is larger than 120 μm, troubles such as carrier streaks may occur and cause deterioration of the quality of image.

Therefore, an average particle size of a carrier of 25–110 μm is more preferable and an average particle size of 30–100 μm is more further preferable.

(2) Electroconductivity

Next, an electroconductivity of a carrier in a first embodiment will be explained. Although such an optimal electroconductivity of a carrier depends on the system of the developer in which the carrier is used, a carrier having a value of $1\times10^{7}$–$1\times10^{14}$ Ω·cm as a resistance value is preferred in general.

If the above-value is lower than $1\times10^{7}$ Ω·cm a carrier development phenomenon or an overlapping phenomenon may occur. If the above-value is higher than $1\times10^{14}$ Ω·cm, deterioration in the quality of image such as lowering of the image density may occur.

Therefore, an electroconductivity of a carrier of $1\times10^{8}$–$1\times10^{13}$ Ω·cm is more preferable and an electroconductivity of $1\times10^{9}$–$10^{12}$ Ω·cm is more further preferable.

Note that resistance values is determined by placing a carrier layer having an electrode area of 5 $cm^2$, a load of 1 kgf, and a thickness of 0.5 cm, applying a voltage of 1–500 V to both upper and lower electrodes, measuring current values flowing in the bottom, and converting the values.

(3) Characteristics of the Moisture Resistance

Next, characteristics of the moisture resistance of the carrier in the first embodiment will be explained. It is preferable to adopt the ratio of water contents as an index for characteristics of the moisture resistance. When the water content of the electrophotographic carrier after it is allowed to stand at a temperature of 20° C. and a humidity of 50 % for 48 hours is designated as Q1 and the water content after it is allowed to stand at a temperature of 50° C. and a humidity of 90 % for 48 hours is designated as Q2, preferably the ratio Q1/Q2 is designed to be about 0.75 or more.

This rating is defined based on the finding of the fact that there is a high relationship between a variation in water content at a temperature of 50° C and a humidity of 90% and a variation in charge quantity when the carrier is allowed to stand in a field for one month.

The ratio Q1/Q2 is more preferably 0.80 or more and most preferably 0.85 or more accordingly.

(Second Embodiment)

The second embodiment of the present invention is a modification of the first embodiment. To mention in detail, this embodiment, as shown by conceptual views of FIGS. 3 and 4, is an electrophotographic carrier 20 in which a hydrophobic white conductive material and a hydrophilic conductive material or either one of the both (one or both of these white conductive materials called second white conductive material 24) is filled (locally present) in a concave portion of the coating layer 29 besides a hydrophobic conductive material (first white conductive material) 26 contained in a coating layer 29.

It is to be noted that a concave portion 25 is present in the stage of filling the second white conductive material 24 but becomes extinct in a smoothing step described later and is not hence shown in the electrophotographic carrier 20 of FIGS. 3 and 4.

Figure 3:
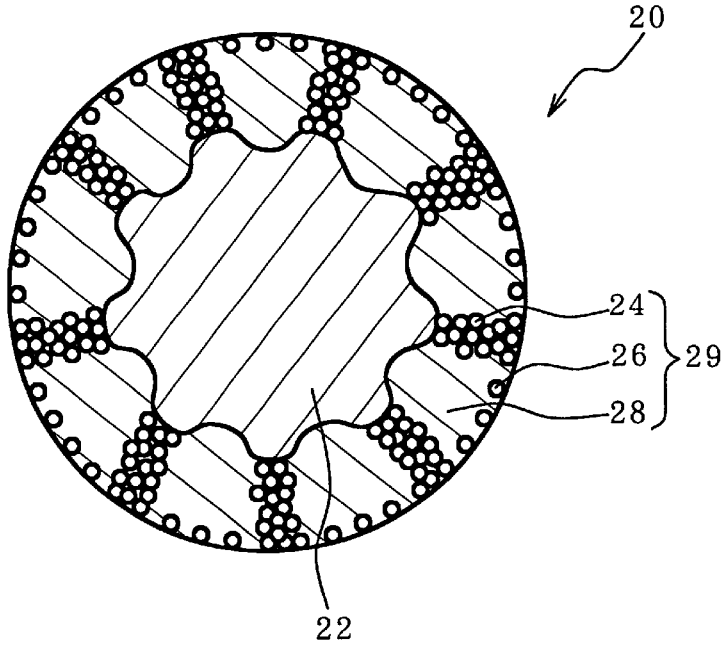
FIG. 3 is a view typically showing a carrier for electrophotography in a second embodiment.
Figure 4:
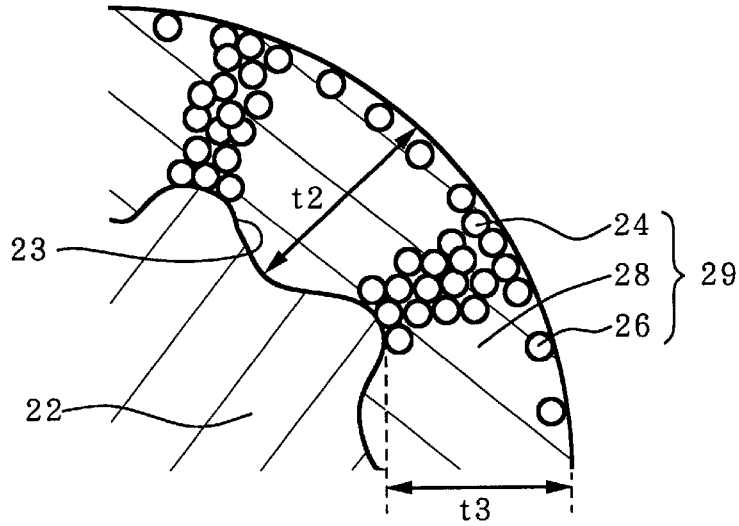
FIG. 4 is an enlarged view of a part of the carrier for electrophotography in the second embodiment.

As shown in FIGS. 3 and 4, a concave portion 23 positioned away at a distance "t2" from the surface of the coating layer 29 is a cavity formed in the carrier core material 22 and differs from the concave portion 25 formed in the coating layer 29. Specifically, a catalyst is carried in the concave portion 23 of the carrier core material 22 and the high molecular weight polyethylene resin constituting the coating layer 29 is ununiformly polymerized around the central concave portion with the result that the concave portion 25 is formed in the surface of the coating layer 29.

Hereinafter, a discussion will be followed primarily on the second white conductive material, which is not comprised in the first embodiment and the explanations of the same structures will be omitted appropriately.

(1) Type of Second White Conductive Material

As the second white conductive material, white conductive materials, which are the same types and have the same average particle diameter as the first white conductive materials explained in the first embodiment may be used. However, because the second white conductive material is filled in the concave portion of the coating layer and fully coated with the high molecular weight polyethylene resin, there are a few possibilities for absorbing water. Therefore, the second white conductive material is not necessarily hydrophobic and may be hydrophilic.

(2) Amount of the Second White Conductive Material to be Added

Although no particular restriction is placed on the amount of the second white conductive material to be added, for instance, the amount is preferably in a range of 0.1 to 100 % by weight when the amount of the high molecular weight polyethylene to be applied is defined as 100 % by weight as the amount of the additive for the coating resin.

This reason is that if the amount of the second white conductive material is less than 0.1 % by weight, there is the case where it is difficult to obtain desired conductivity. On the other hand, if the amount exceeds 100 % by weight, there is the case where the second white conductive material is uniformly embedded with difficulty and becomes susceptible to the influence of environmental variations and an increase in the amount of the conductive material which is fallen off causes the generation of dulling and a change in the resistance.

Therefore, the amount of the second white conductive material is in a range of, more preferably, 1 to 100 % by weight and most preferably 10 to 100 % by weight based on 100 % by weight of the high molecular weight polyethylene to be applied.

(3) Concave Portion of the Coating Layer

Preferably the concave portion of the coating layer has a deep level enough to prevent the second white conductive material from falling off in the condition that the second white conductive material is filled in the concave portion. Specifically, the depth of the concave portion in the coating layer is preferably in a range of 0.01 to 3 $\mu$m. The reason is that if the depth of the concave portion in the coating layer is less than 0.01 $\mu$m, there is the case that the second white conductive material tends to fall off whereas if the depth of the concave portion in the coating layer exceeds 3 $\mu$m, there is the case where the mechanical strength of the carrier is reduced.

Hence, the depth of the concave portion in the coating layer is in a range of, more preferably, 0.05 to 2 $\mu$m, and most preferably 0.1 to 1 $\mu$m.

Although no particular limitation is imposed on a method for the production of the concave portion of the coating layer, the concave portion is easily formed using a carrier core material having concave portions on the surface thereof by carrying a catalyst in the concave portion and coating the concave portion with a high molecular weight polyethylene resin.

(Third Embodiment)

Figure 6:
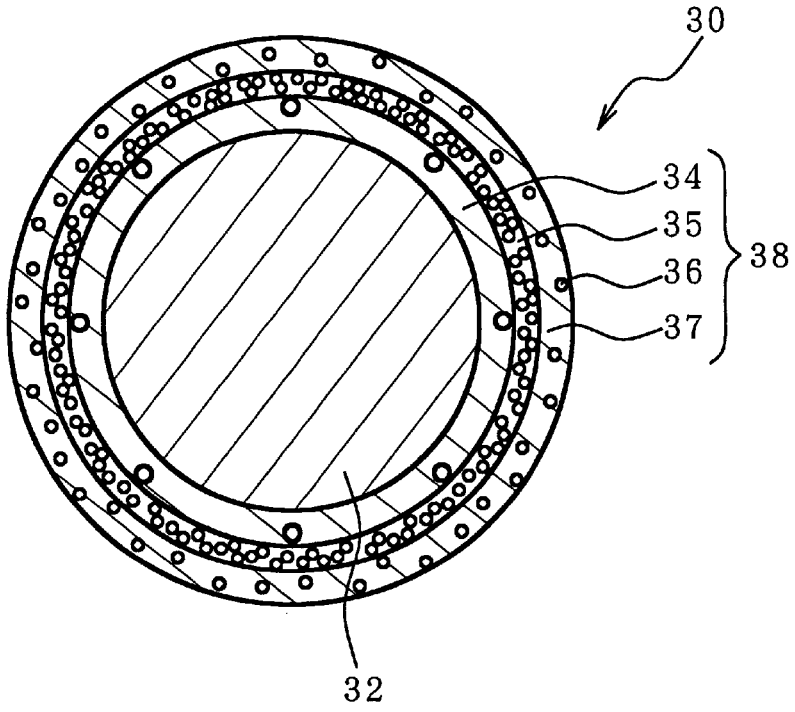
FIG. 6 is a view typically showing a carrier for electrophotography in a third embodiment.
Figure 7:
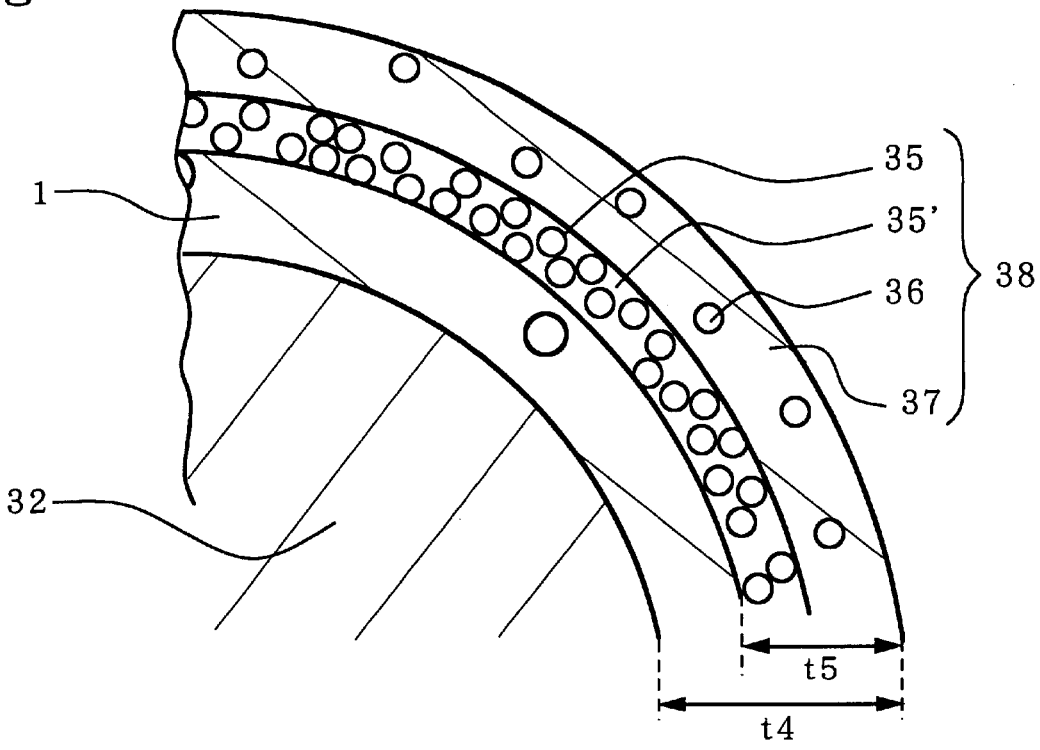
FIG. 7 is an enlarged view of a part of the carrier for electrophotography in the third embodiment.

The third embodiment of the present invention is another modification of the first embodiment. This embodiment, as shown in FIGS. 6 and 7, is an electrophotographic carrier 30 in which a conductive layer 35' comprising a hydrophobic white conductive material and a hydrophilic conductive material or either one of the both (one or both of these white conductive materials called a third white conductive material 35) is formed at a position away at a distance "t5" from the surface of a coating layer 38 besides a hydrophobic conductive material (first white conductive material) 36 contained in the coating layer 38.

Hereinafter, a discussion will be followed primarily on the third white conductive material, which is not comprised in the first embodiment and the explanations of the same structures will be omitted appropriately.

(1) Type of the Third White Conductive Material

As the third white conductive material, white conductive materials which are the same types and have the same average particle diameter and the like as the first white conductive materials explained in the first embodiment may be used. However, because the third white conductive material forms a conductive layer within the coating layer, there are a few possibilities for absorbing water. Therefore, the third white conductive material is not necessarily hydrophobic and may be hydrophilic.

(2) Amount of the Third White Conductive Material

With respect to the amount of the third white conductive material which is not particular restricted, it is preferably in a range of 0.1 to 150 % by weight based on 100 % by weight of the amount of the high molecular weight polyethylene as the amount of the additives for the coating resin.

This reason is that if the amount of the third white conductive material is less than 0.1 % by weight, there is the case where it is difficult to obtain desired conductivity. On the other hand, if the amount of the third white conductive material exceeds 150 % by weight, there is the case where the third white conductive material is uniformly embedded with difficulty and becomes susceptible to the influence of environmental variations and an increase in the amount of the conductive material which is fallen off causes the generation of dulling and a change in the resistance.

Therefore, the amount of the third white conductive material is more preferably in a range of 1 to 130 % by weight, and most preferably 10 to 120 % by weight based on 100 % by weight of the high molecular weight polyethylene to be applied.

(3) Conductive Layer

The conductive layer may be a layer having electroconductivity or an electroconductive region which is formed by allowing the third white conductive material to exist in a large amount in a range from the surface of the coating layer to a prescribed depth, for example, 1 μm. Concretely, the distance represented by the symbol "t5" in FIG. 7 is preferably within 1 μm. If the distance is out of the above-defined range, there is the case where charging characteristics are not improved even if a conductive layer is present.

Incidentally, the presence of such a conductive layer can be confirmed using an Auger electron spectroscope. Specifically, the distribution of the white conductive materials 35, 36 in the structure shown in FIG. 7 is analyzed using the Auger electron spectroscope, it is confirmed that almost no white conductive material is present inside of the coating layer 38, namely, on the side close to the carrier core material. It is understood that the existential probability of the white conductive material reaches a peak in the conductive layer 35 existing in a range to a depth within 1 μm, showing that the third white conductive material 36 exists in a large amount in this range. The first white conductive material 35 eventually exists on the outside of the coating layer 38, that is, on the surface side, though its amount is smaller than that of an existent conductive layer 35'. Accordingly, the presence of the conductive layer 35' can be confirmed from a chart of the existential probability of the white conductive material, which is obtained using an Auger electron spectroscope.

Although there is no limitation to the thickness of the conductive layer, for example, the thickness is preferably in a range of 0.5 to 3 μm. This reason is that if the thickness is less than 0.5 μm, there is the case where the conductivity becomes ununiform whereas if the thickness exceeds 3 μm, it is difficult to form the conductive layer.

Hence, the thickness of the conductive layer is in a range more preferably of 0.7 to 2.5 μm and most preferably of 1 to 2 μm.

Although no particular limitation is imposed on a method for forming the conductive layer, for example, the conductive layer can be formed with ease by embedding the third white conductive material in the high molecular weight polyethylene as the coating layer by a mechanical impact.

(Fourth Embodiment)

The fourth embodiment of the present invention is a process for producing an electrophotographic carrier and comprises:

i) a step of coating the surface of a carrier core material having a concave portion with a high molecular weight polyethylene resin by a direct polymerization method (first step);

ii) a step of filling a white conductive material (second white conductive material) in the concave portion of the high molecular weight polyethylene resin (step of filling the second white conductive material);

iii) a step of smoothing the surface (smoothing step); and iv) a step of adding a hydrophobic white conductive material (first white conductive material) in the high molecular weight polyethylene resin by a mechanical impact (second step).

(1) First Step

This is a step of coating the carrier core material with the high molecular weight polyethylene resin. Although there is no particular limitation to such a coating method, it is preferable to adopt, for instance, a direct polymerization method as explained in the first embodiment because of large strength of a resin coating and resistance to the peeling of the coating layer.

The use of the carrier core material having the concave portion ensures that a catalyst can be carried in the concave portion and the high molecular weight polyethylene resin can be ununiformly applied. Therefore, a concave portion (including, for example, a cavity, groove and hole) is easily formed in the coating layer.

Figure 8:
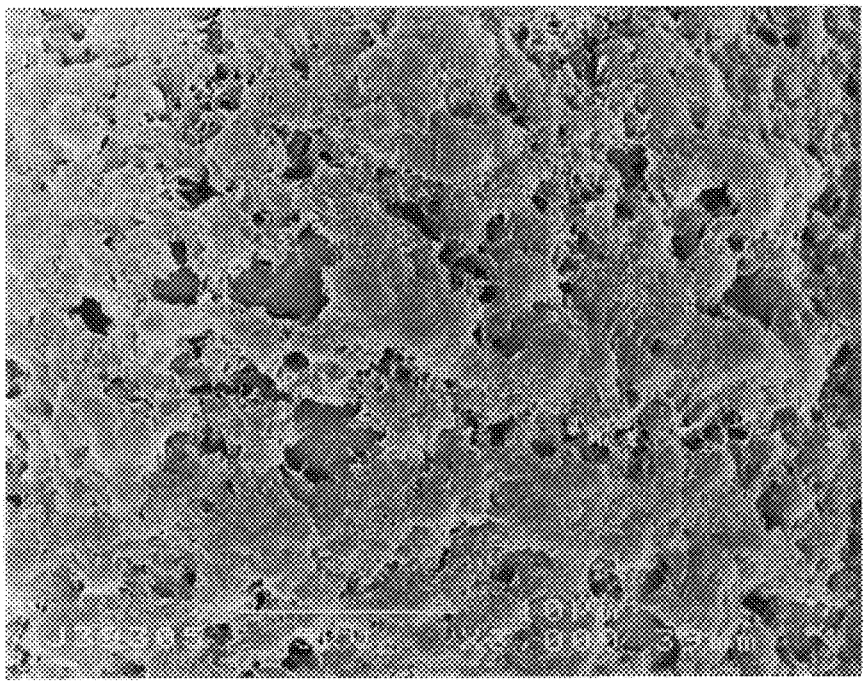
FIG. 8 is an electron micrograph (magnification: 700 times) of a carrier A2.
Figure 9:
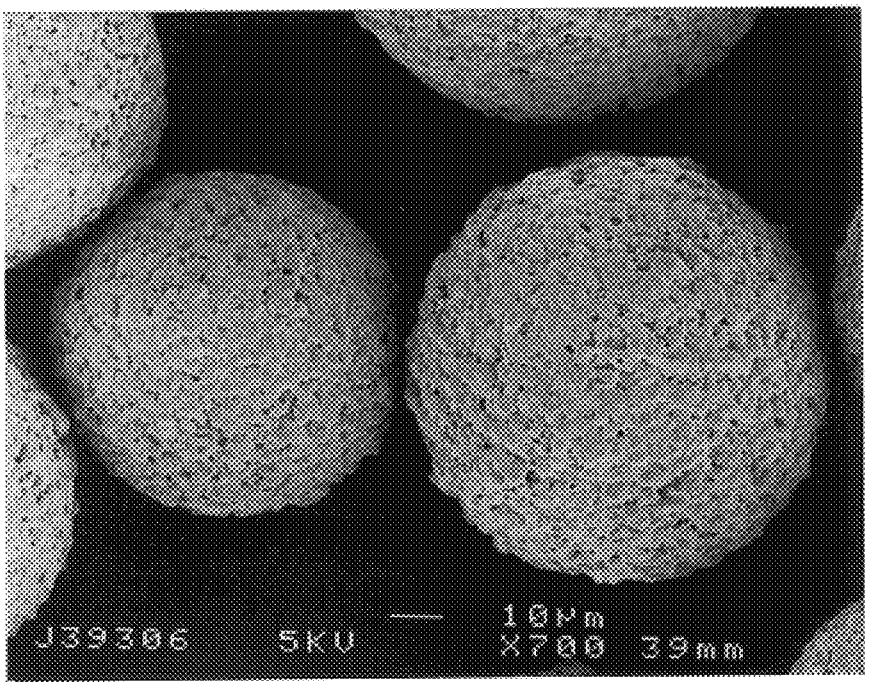
FIG. 9 is an electron micrograph (magnification: 3,000 times) of the carrier A2.

Electron micrographs of the carrier core material which is coated with the high molecular weight polyethylene resin are shown in FIG. 8 (magnification: 700 times) and FIG. 9 (magnification: 3,000 times). From these electron micrographs, it is understood that the concave portion is partly formed in the surface of the coating layer.

(2) Step of Filling a Second White Conductive material

The step of filling the second white conductive material is a step of filling a hydrophobic white conductive material and a hydrophilic white conductive material or either one of the both (one or both of these white conductive materials are called a second white conductive material) in the concave portion formed in the coating layer besides the hydrophobic white conductive material (first white conductive material) contained in the coating layer.

Although no particular restriction is placed on a method of filling the second white conductive material, it is desirable to fill by, for example, a mechanical impact because the second white conductive material is uniformly filled in a short time. To state more concretely, for instance, the second white conductive material can be filled by stirring treatment using a Henshel mixer in the condition of temperatures ranging from room temperature (20° C.) to 90° C., a rotation of 400 rpm and a stirring time ranging from 0.5 to 3 hours.

Accordingly electroconductivity can be provided in the direction of the thickness of the electrophotographic carrier by the second white conductive material which is filled in this manner. Hence the second white conductive material works together with the white conductive material which is contained in the coating layer and provides electroconductivity in the direction of the plane of the electrophotographic carrier, enabling the whole electrophotographic carrier to possess more excellent charging characteristics.

Figure 5:
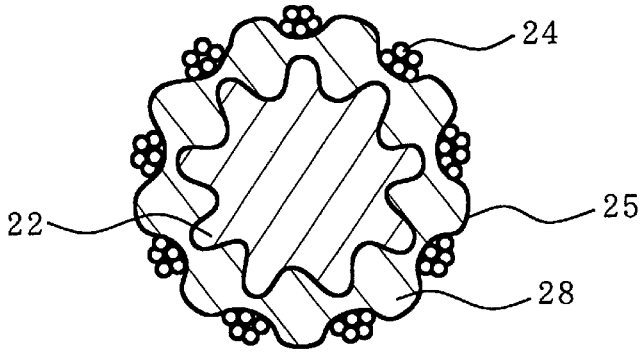
FIG. 5 is a view typically showing the carrier for electrophotography (in intermediate stages) in a second embodiment.
Figure 10:
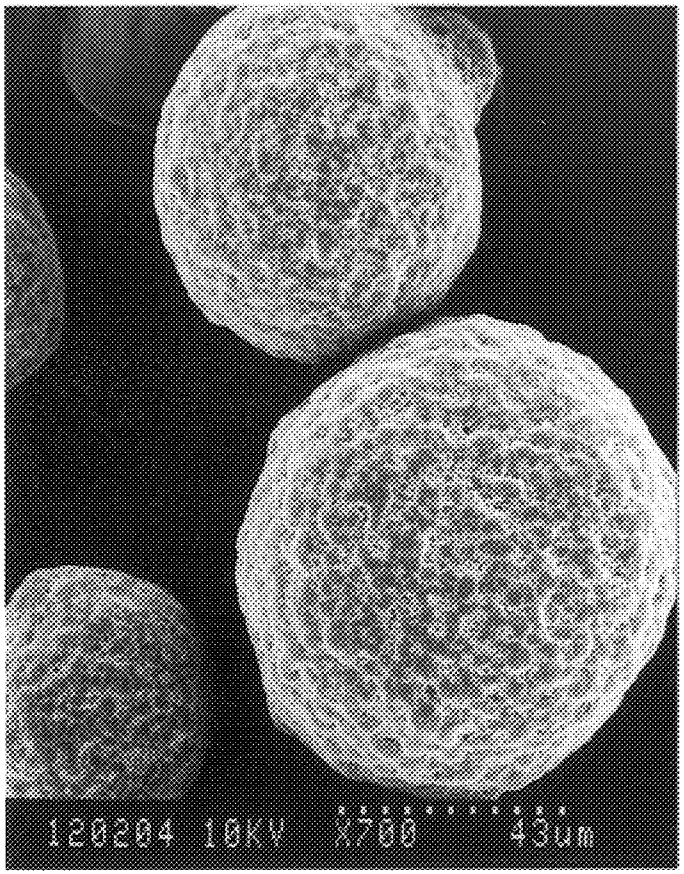
FIG. 10 is an electron micrograph (magnification: 700 times) showing the condition of the carrier A2 to which conductive titanium oxide is added.
Figure 11:
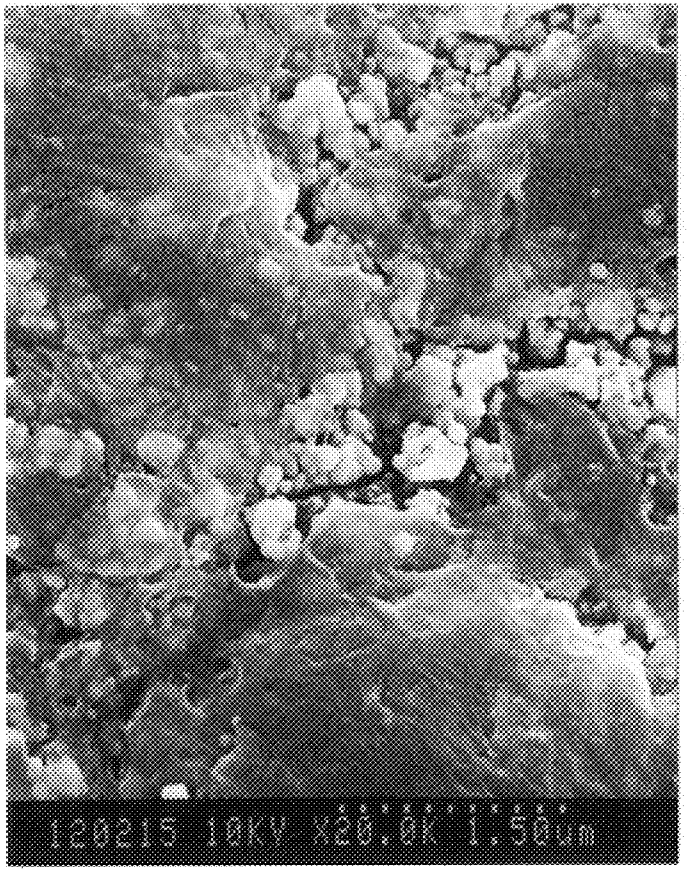
FIG. 11 is an electron micrograph (magnification: 20,000 times) showing the condition of the carrier A2 to which conductive titanium oxide is added.

Electron micrographs of the carrier when the second white conductive material is filled are shown in FIG. 10 (magnification: 700 times) and FIG. 11 (magnification: 20,000 times) and FIG. 5 shows a typical view. From these electron micrographs, it is understood that the second white conductive material 24 is locally filled in the concave portion 25 of the coating layer 28.

(3) Smoothing Step

The smoothing step is a step of smoothing by filling the concave portion with the high molecular weight polyethylene resin of the coating layer with the second white conductive material being localized. By this smoothing step, the concave portion filled with the second white conductive material is smoothed and the second white conductive material is embedded with the result that the second white conductive material is never fallen off. Also, the smoothing of the surface renders it possible to add a hydrophobic white conductive material uniformly in the next step.

Although there is no particular restriction on a method of executing the smoothing step, the smoothing can be made by performing stirring treatment using a Henshel mixer in the condition of temperatures ranging from room temperature (20° C.) to 90° C., a rotation ranging from 800 to 1600 rpm and a stirring time ranging from 0.5 to 3 hours.

Figure 12:
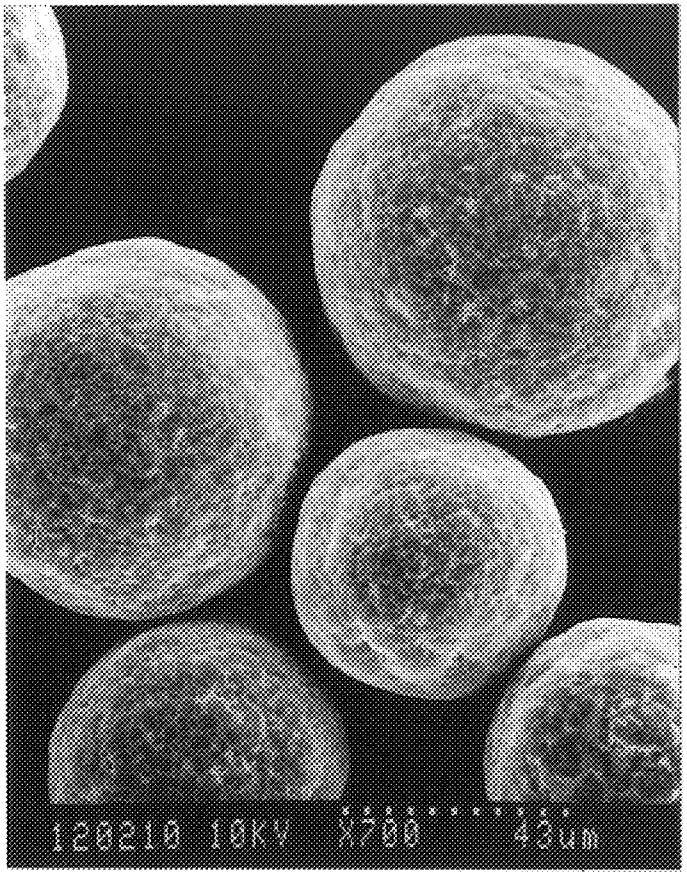
FIG. 12 is an electron micrograph (magnification: 700 times) of the carrier A2 which is smoothed after conductive titanium oxide is added.
Figure 13:
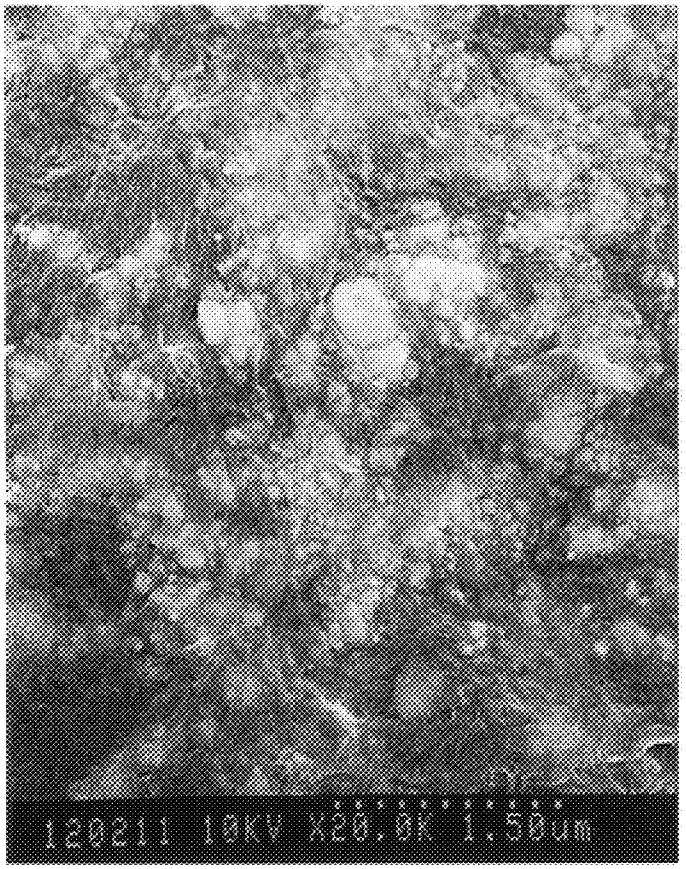
FIG. 13 is an electron micrograph (magnification: 20,000 times) of the carrier A2 which is smoothed after conductive titanium oxide is added.

Electron Micrographs of the Carrier When the Concave portion is smoothed are shown in FIG. 12 (magnification: 700 times) and FIG. 13 (magnification: 20,000 times). From these electron micrographs, it is understood that the surface is smoothed with the second white conductive material being locally filled in the concave portion of the coating layer.

(4) Second Step

This is a step of introducing the hydrophobic white conductive material (first white conductive material) into the high molecular weight polyethylene resin of the coating layer by a mechanical impact.

More concretely, the first white conductive material can be embedded by performing stirring treatment using a Henshel mixer in the condition of temperatures ranging from room temperature (20° C.) to 90° C., a rotation of 1,600 rpm and a stirring time ranging from 1 to 10 hours.

The first white conductive material added in this manner can provide electroconductivity in the direction of the horizontal plane of the electrophotographic carrier and hence works together with the second white conductive material which is contained in the coating layer and provides electroconductivity in the direction of the depth of the electrophotographic carrier, enabling the whole electrophotographic carrier to possess more excellent charging characteristics.

Figure 14:
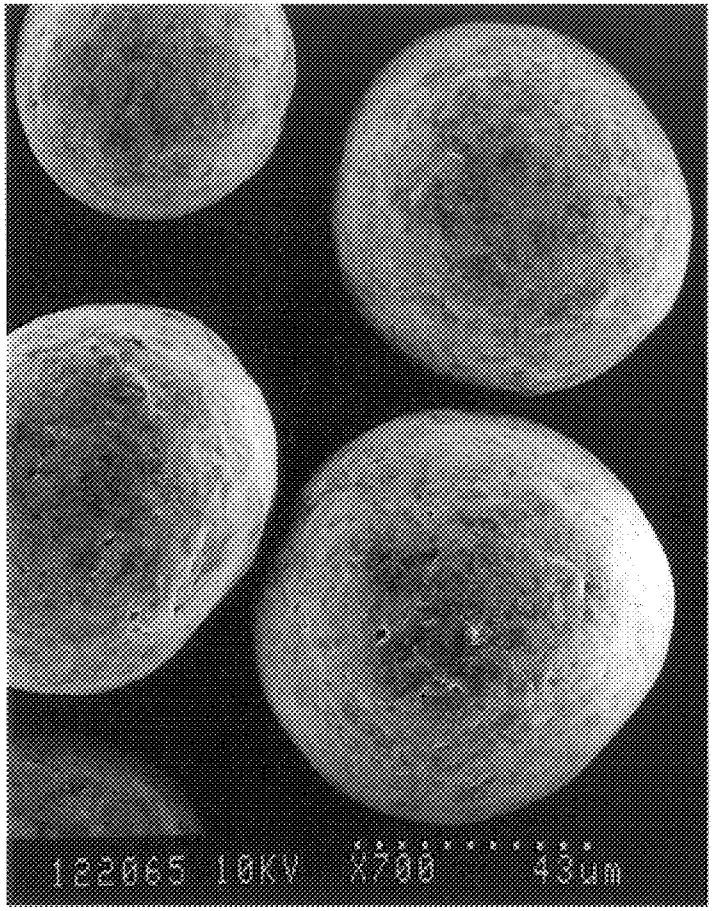
FIG. 14 is an electron micrograph (magnification: 700 times) of a carrier B.
Figure 15:
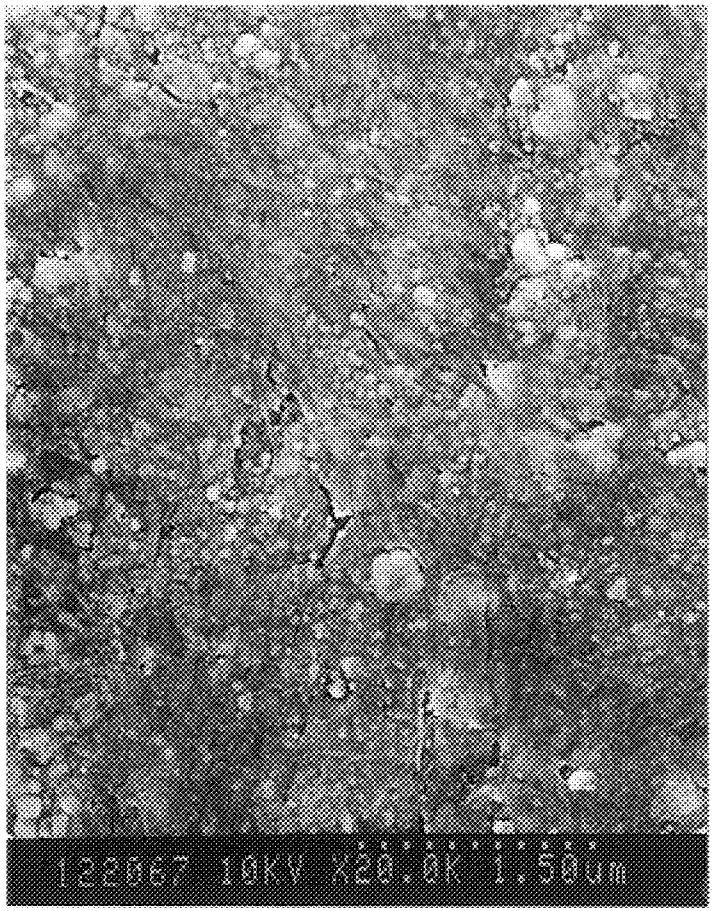
FIG. 15 is an electron micrograph (magnification: 20,000 times) of the carrier B.

Electron micrographs of the carrier when the first white conductive material is added by a mechanical impact are shown in FIG. 14 (magnification: 700 times) and FIG. 15 (magnification: 20,000 times). From these electron micrographs, it is understood that the first white conductive material is embedded in the polyethylene resin on the surface of the coating layer.

(Fifth Embodiment)

The fifth embodiment of the present invention is another process for producing an electrophotographic carrier and comprises in order:

i) a step of coating the surface of a carrier core material having a concave portion with a high molecular weight polyethylene resin by a direct polymerization method (first step);

ii) a step of smoothing the surface (smoothing step);

iii) a step of filling a white conductive material (third white conductive material) in the high molecular weight polyethylene resin by a mechanical impact to form a conductive layer (step of filling the third white conductive material); and iv) a step of introducing a hydrophobic white conductive material (first white conductive material) in the high molecular weight polyethylene resin by a mechanical impact (second step).

(1) First Step

This is a step of coating the carrier core material with the high molecular weight polyethylene resin and is the same as explained in the fourth embodiment.

(2) Smoothing Step

The smoothing step is a step of smoothing by filling the concave portion with the high molecular weight polyethylene resin of the coating layer. The smoothing step renders it possible to add the third white conductive material uniformly in the next step.

Although there is no particular restriction on a method of executing the smoothing step, the smoothing can be made by performing stirring treatment using a Henshel mixer in the condition of temperatures ranging from room temperature (20° C.) to 90° C., a rotation ranging from 800 to 1,600 rpm and a stirring time ranging from 0.5 to 3 hours.

(3) Step of Filling a Third White Conductive Material

The step of filling the third white conductive material is a step of filling a relatively large amount of a hydrophobic white conductive material and a hydrophilic white conductive material or either one of the both (one or both of these white conductive materials are called a third white conductive material) inside of the coating layer besides the hydrophobic white conductive material (first white conductive material) contained in the coating layer to form a conductive layer.

Although no particular restriction is placed on a method of filling the third white conductive material, it is desirable to fill by, for example, a mechanical impact because the third white conductive material is uniformly filled in a short time. To state more concretely, for instance, the third white conductive material can be embedded by stirring treatment using a Henshel mixer in the condition of temperatures ranging from room temperature (20° C.) to 90° C., a rotation of 1600 rpm and a stirring time ranging from 1 to 10 hours.

Accordingly electroconductivity can be provided in the direction of the thickness of the electrophotographic carrier by the third white conductive material which is filled in this manner. Hence the third white conductive material works together with the first white conductive material which is contained in the coating layer and provides electroconductivity in the direction of the plane of the electrophotographic carrier, enabling the whole electrophotographic carrier to possess more excellent charging characteristics.

Figure 16:
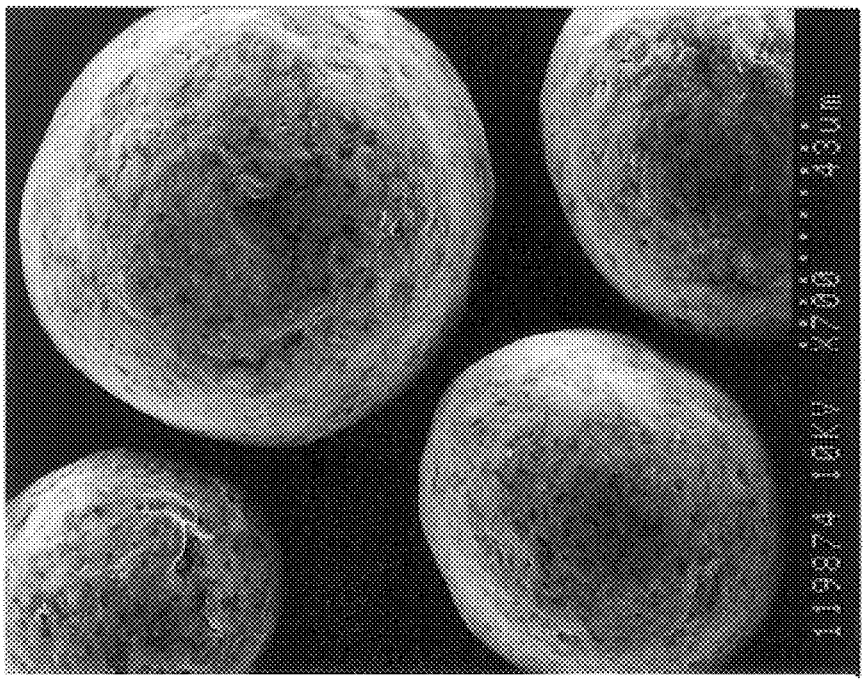
FIG. 16 is an electron micrograph (magnification: 700 times) showing the condition of the carrier A2 to which hydrophobic conductive zinc oxide is added after the carrier A2 is smoothed.
Figure 17:
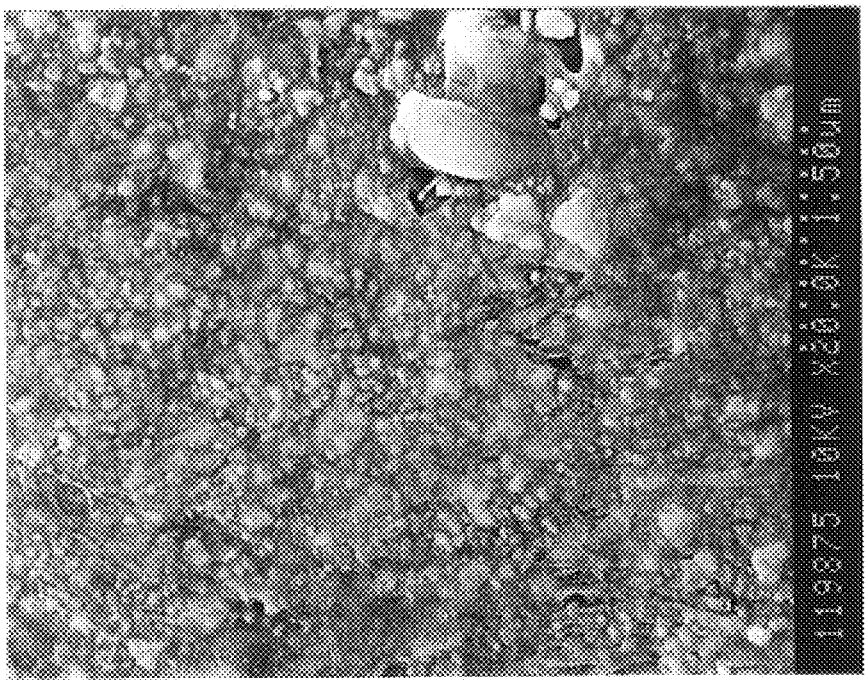
FIG. 17 is an electron micrograph (magnification: 20,000 times) showing the condition of the carrier A2 to which hydrophobic conductive zinc oxide is added after the carrier A2 is smoothed.

Electron micrographs of the carrier when the third white conductive material is embedded to form the conductive layer are shown in FIG. 16 (magnification: 700 times) and FIG. 17 (magnification: 20,000 times). From these electron micrographs, it is understood that a relatively large amount of the third white conductive material is embedded.

(4) Second Step

This is a step of introducing a hydrophobic white conductive material (first white conductive material) into the high molecular weight polyethylene resin of the coating layer by a mechanical impact and is the same as that in the fourth embodiment.

The first white conductive material added in this manner can provide electroconductivity in the direction of the horizontal plane of the electrophotographic carrier and hence works together with the third white conductive material which is contained in the coating layer and provides electroconductivity in the direction of the depth of the electrophotographic carrier, enabling the whole electrophotographic carrier to possess more excellent charging characteristics.

Figure 18:
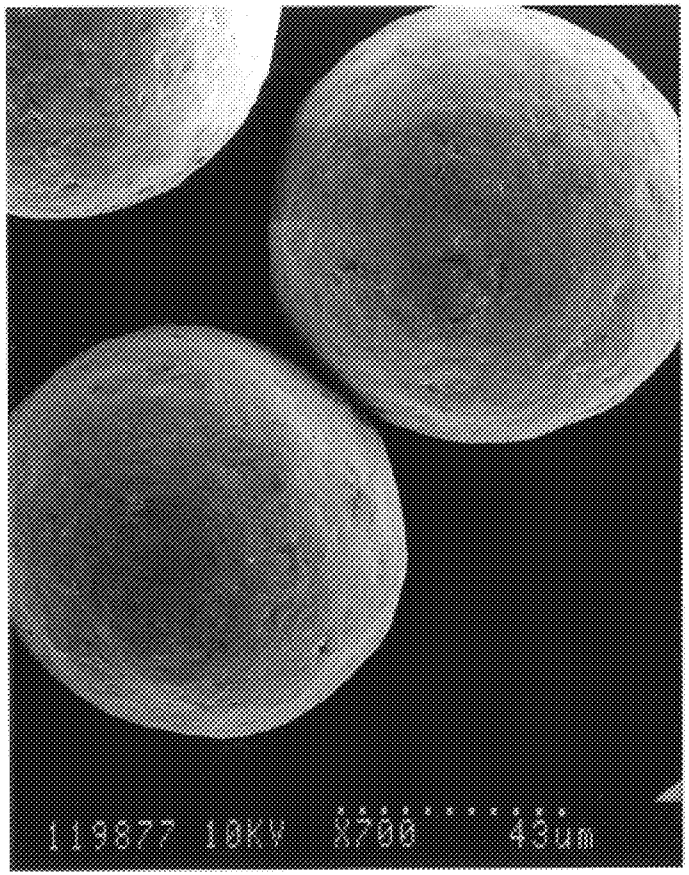
FIG. 18 is an electron micrograph (magnification: 700 times) of a carrier E.
Figure 19:
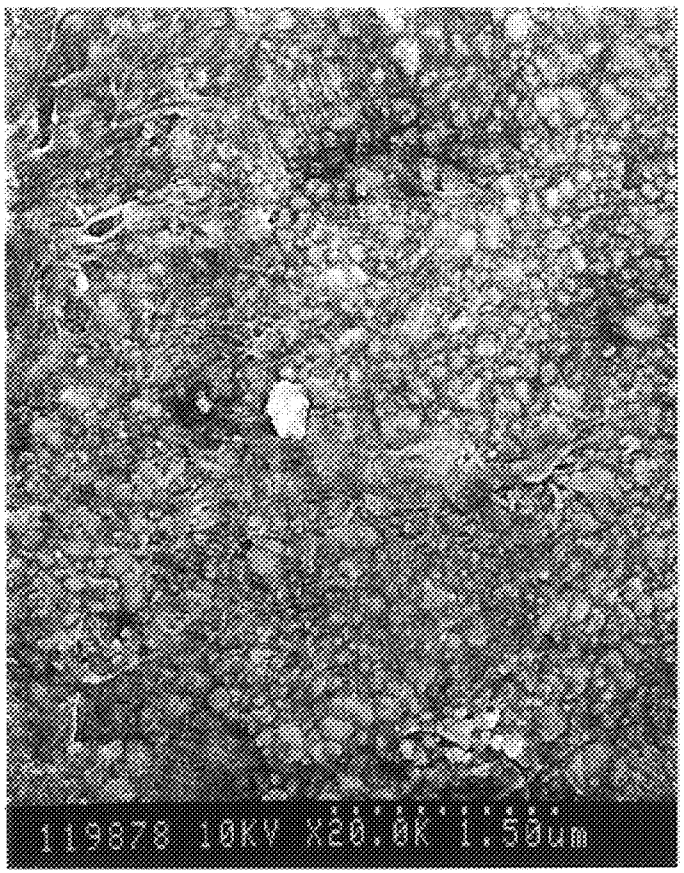
FIG. 19 is an electron micrograph (magnification: 20,000 times) of the carrier E.

Electron micrographs of the carrier when the first white conductive material is added by a mechanical impact are shown in FIG. 18 (magnification: 700 times) and FIG. 19 (magnification: 20,000 times). From these electron micrographs, it is understood that the first white conductive material is farther embedded above the third white conductive material in the polyethylene resin on the surface of the coating layer.

(Sixth Embodiment)

The sixth embodiment of the present invention is an electrophotographic developer and can be obtained by blending various toners to each of the carriers of the aforementioned first to third embodiments.

1. Toner

As a toner used in the present invention, the toner, which was produced according to a well-known method such as the suspension polymerization method, the crushing method, the encapsuling (microcapsuling) method, the spray dry method, and the mechanochemical method, can be used, and at least binder resins, coloring agents, and other additives such as electric charge-controlling agents, lubricants, off-set-preventing agents, and fixation-enhancing agents can be formulated, if necessary, to effectively improve a developing property and prevent scattering of a toner in the machine. In addition, fluidizing agents can also be added to improve its fluidizability. Binder resins which can be used are polystylene-based resins such as polystylene, stylene/butadiene copolymer, and stylene/acryl copolymer; ethylene-based copolymers such as polyethylene, ethylene/vinyl acetate copolymer, and ethylene/vinyl alcohol copolymer; epoxy-based resins; phenol-based resins; acryl phthalate resin; polyamide resin; polyester-based resins; and maleic acid resin. Coloring agents which can be used are well known dyes/pigments such as carbon black, Copper Phthalocyanine Blue, Indus Melia Blue, Peacock Blue, Permanent Red, Red Oxide, Alizarin Rake, Chrome Green, Malachite Green Rake, Methyl Violet Rake, Hansa Yellow, Permanent Yellow, and titanium oxide. Electric charge-controlling agents which can be used are positive electric charge-controlling agents such as nigrosin, nigrosin base, triphenylmethane-based compounds, polyvinylpyridine, and quaternary ammonium salt; and negative electric charge-controlling agents such as metal-complexes of alkyl-substituted salicylic acid (e.g. a chromium complex or a zinc complex of di-tert-butylsalicylic acid). Lubricants which can be used are Teflon, zinc stearate, and polyfluorovinylidene. Off-set-preventing/fixation-enhancing agents which can be used are a polyolefin wax or the like such as low-molecular-weight polypropylene and its modification. Magnetic materials which can be used are magnetite, ferrite, iron, and nickel. Fluidizing agents which can be used are silica, titanium oxide, aluminum oxide, or the like.

The average size of the toner is preferably equal to or lower than 2 $\mu$m, more preferably 5–15 $\mu$m.

2. Mixing Ratio

The mixing ratio of the toner is designed to be in a range of 2 to 40 % by weight, preferably 3 to 30 % by weight and more preferably 4 to 25 % by weight based on 100 parts by weight of the total amount of the carrier and toner. This is because if the mixing ratio of the toner is less than 2 % by weight, there is the case where the charge quantity of the toner is excessively increased and hence only insufficient image density is obtained. On the other hand, if the mixing ratio exceeds 40 % by weight, there is the case where sufficient charge quantity is not obtained with the result that the toner scatters from a developing unit to thereby soil the inside of the machine and toner overlapping is produced on an image. ps 3. Usage The developer according to the present invention is used in the 2- component-type electrophotography system such as the copying machine (analogue, digital, monochrome, and color type), the printer (monochrome and color type), and the facsimile, especially most suitably in the high-speed/ultra-high-speed copying machine and printer or the like in which the stress applied to the developer is high in the developing machine. There is no particular limitation to the type of image-formation, the type of exposure, the type (apparatus) of development, and various types of control (e.g. the type of controlling the density of a toner in a developing machine). One can adjust it to an optimal resistance, a particle size/particle size distribution, a magnetic power, and an charge quantity of the carrier and the toner, depending on the system.

EXAMPLES

The present invention will be hereinafter explained in more detail by way of examples. In the following explanations, the "part (s)" and "%" mean those on the weight basis, unless otherwise noted.

<Production of Carrier>

(1) Preparation of Titanium-containing Catalytic Component

Into a 500-ml flask whose atmosphere was replaced for argon, 200 ml of dried n-heptane and 15 g (25 mmol) of magnesium stearate that had been dried at 120° C. under a reduced pressure (2 mmHg) were added at room temperature to make a slurry. After 0.44 g (2.3 mmol) of titanium tetrachloride was dropwise added with stirring, the content began to be heated, the reaction was carried out under reflux for 1 hour, and a clear viscous solution of a titanium-containing catalyst (the active catalyst) was obtained.

(2) Evaluation of Activity of Titanium-containing Catalytic Component

Into a 1-liter autoclave whose atmosphere was replaced for argon, 400 ml of dried hexane, 0.8 mmol of triethylaluminum, 0.8 mmol of diethylaluminun chloride, and 0.004 mmol (as titanium atom) of the titanium-containing catalytic component obtained in (1) were added, and the content was heated up to 90° C., wherein the inner pressure of the system was 1.5 kg/cm$^2$G. After hydrogen was supplied, ethylene was continuously supplied maintaining the total pressure at 5.5 kg/cm$^2$G. Polymerization was carried out for 1 hour, giving 70 g of polymer. The polymerization activity was 365 kg/g·Ti/Hr, and MFR (melt flow rate at 190° C., a loading of 2.16 kgf according to JIS K 7210) of the polymer obtained was 40 g/10 min..

(3) Production 1 of Carrier Coated with Polyethylene 960 g of a sintered ferrite powder F-300 (manufactured by Powdertech, average particle diameter: 50 $\mu$m) was placed in an autoclave with an inner volume of 2 little which was replenished with argon and thereafter the temperature was raised to 80° C. to dry the powder under reduced pressure (10 mmHg) for one hour. Then the temperature was dropped down to 40° C. and 800 ml of dehydrated hexane was added to start stirring.

Next, 5.0 mmol of diethylaluminum chloride and the titanium-containing catalyst component of the above (1) (0.05 mmol as converted into a titanium atom) were added to run a reaction for 30 minutes, further the temperature was raised to 90° C. and nitrogen was introduced to adjust the internal pressure to 3.0 kg/cm$^2$G. Thereafter, hydrogen was supplied to raise the internal pressure to 3.5 kg/cm$^2$G, ethylene was introduced until the internal pressure was raised to 4.5 kg/cm$^2$G and 5.0 mmol of triethylaluminum was added to start polymerization.

Ethylene was successively supplied so as to keep the internal pressure of 4.5 kg/cm$^2$G as it was to continue the polymerization for 45 minutes (the introduction of ethylene was stopped when ethylene was introduced in an amount of 40 g in total), thereby preparing ferrite coated with a polyethylene resin in a total amount of 1,000 g. The resultant dry powder exhibited a slightly whitish black color and it was found by observation using an electron microscope that the surface of ferrite was coated thinly with polyethylene. The carrier in this stage is hereinafter designated as a carrier A1.

The resultant composition was measured by TGA (thermobalance) to find that the component ratio of ferrite to polyethylene was 96:4 (ratio by weight). The weight average molecular weight of coating polyethylene measured by GPC was 167,000.

Then, carrier A1 was classified using a sieve of 125 μm to remove particles which are equal to or larger than 125 μm in diameter. The carrier after the classification was added into a fluidized-bed type gas-flow classifier having a height of 14 cm, and heated air (90° C.) was blown in to give at a linear velocity of 20 cm to fluidize the carrier for 10 hours. Thus carrier A2 was obtained. The carrier Al classified in this way in this stage is hereinafter designated as a carrier A2 (See FIG. 8 and 9.).

(4) Production 2 of Carrier Coated with Polyethylene 960 g of a sintered ferrite powder F-300 (manufactured by Powdertech, average particle diameter: 50 μm) was placed in an autoclave with an inner volume of 2 little which was replenished with argon and thereafter the temperature was raised to 80° C. to dry the powder under reduced pressure (10 mmHg) for one hour. Then the temperature was dropped down to 40° C. and 800 ml of dehydrated hexane was added to start stirring.

Next, 5.0 mmol of diethylaluminum chloride and the titanium-containing catalyst component of the above (1) (0.05 mmol as a titanium atom) were added to run a reaction for 30 minutes, further the temperature was raised to 90° C. and 4 g of ethylene was introduced. The internal pressure at this time was 3.0 kg/cm$^2$G. Thereafter, hydrogen was supplied to raise the internal pressure to 3.2 kg/cm$^2$G and 5.0 mmol of triethylaluminum was added to start polymerization. Then the internal pressure was decreased to 2.3 kg/cm$^2$G in about 5 minutes and became stable.

Next, a slurry-like substance produced from 20 g of conductive titanium oxide whose surface was made hydrophobic (the surface of ET300W was processed by hydrophobic treatment, manufactured by Ishihara Sangyo Kaisha Ltd., average particle diameter: 0.03 μm) and 100 ml of dehydrated hexane was introduced. Then, ethylene was successively supplied so as to keep the internal pressure of 4.3 kg/cm$_2$G to continue the polymerization for 45 minutes (the introduction of ethylene was stopped when ethylene was introduced into the system in an amount of 40 g in total), thereby preparing ferrite coated with a polyethylene resin containing conductive titanium oxide whose surface was made hydrophobic in a total amount of 1020 g.

The resultant dry powder exhibited a uniform black color and it was found by observation using an electron microscope that the surface of ferrite was coated thinly with polyethylene and conductive titanium oxide whose surface was made hydrophobic was uniformly dispersed in polyethylene. The weight average molecular weight of coating polyethylene measured by GPC was 192,000. The carrier in this stage is hereinafter designated as carrier A3.

Then, the carrier A3 was classified using a sieve of 125 μm to remove particles which are equal to or larger than 125 μm in diameter. The carrier after the classification was added into a fluidized-bed type gas-flow classifier having a height of 14 cm, and heated air (90° C.) was blown in to give at a linear velocity of 20 cm to fluidize the carrier for 10 hours. The carrier in this stage is hereinafter designated as carrier A4.

(5) Production 3 of Polyethylene-coated Carrier

Into a 2-liter autoclave whose atmosphere was replaced for argon, 960 g of sintered ferrite powder F-300 (Powder Tech Corp., average particle size 50 μm) was added, the content was heated up to 80° C., and drying was carried out under a reduced pressure (10 mmHg) for 1 hour. After the content was cooled down to 40° C., 800 ml of dried hexane was added, and mixing was started. After 5.0 mmol of diethylaluminum chloride and the titanium-containing catalytic component described in (1) (0.05 mmol as titanium atom) were added, reaction was carried out for 30 min. Then the content was heated up to 90° C., 4 g of ethylene was introduced, with the inner pressure being 3.0 kg/cm$^2$G. After hydrogen was supplied up to 3.2 kg/cm$^2$G, 5.0 mmol of triethylaluminum was added to start polymerization. The inner pressure of the system went down to and was stabilized at 2.3 kg/cm$^2$G in ca. 5 min. Then, a slurry containing 5.5 g of carbon black (Mitsubishi Chem. Co., MA-100) in 100 ml of dried hexane was added, polymerization was carried out continuously supplying ethylene, with keeping the inner pressure at 4.3 kg/cm$^2$G for 45 min (the supply was stopped when 40 g of ethylene was introduced into the system), and 1005.5 g of carbon black-containing polyethylene resin-coated ferrite was obtained. The resultant dry powder exhibited a uniform black color and it was found by observation using an electron microscope that the surface of the ferrite was coated with a thin polyethylene layer and the carbon black is uniformly dispersed in the polyethylene layer. Also, thermal gravimetric analysis (TGA) of the composite revealed that the weight ratio of ferrite/carbon black/polyethylene was 95.5/0.5/4.0.

The intermediate-step carrier obtained through this step was designated as "the carrier A5". The weight-average molecular weight of the coating polyethylene was 206,000.

Then carrier A5 was classified using a sieve of 125 μm to remove particles which are equal to or larger than 125 μm in diameter. The carrier after the classification was added into a fluidized-bed type gas-flow classifier having a height of 14 cm, and heated air (115° C.) was blown in to give at a linear velocity of 20 cm to fluidize the carrier for 10 hours. Thus carrier A6 was obtained.

<Production of a Toner>

(1) Production of Magenta Toner (Toner A)

In the production of a magenta toner, the materials i) –iv) described below were sufficiently mixed using a ball mill and then kneaded on a three-role heated to 140° C. After the mixture was allowed to stand for cooling, it was pulverized using a feather mill and further using a jet mill to obtain a toner fine powder. The materials v) and vi) described below were mixed to the resultant toner fine powder and the toner mixture was mixed using a Henshel mixer to obtain a magenta toner (toner A).

| | |
|---|---|
| i) Polyester resin | 93 parts by weight |
| ii) Naphthol type pigment | 5 parts by weight |
| iii) Polypropylene type wax | 1 part by weight |
| iv) Charge control agent (quaternary ammonium complex) | 1 part by weight |
| v) External additive (titania) | 1% by weight |
| vi) External additive (silica) | 0.6% by weight |

(2) Production of Yellow Toner (Toner B)

In the production of a yellow toner, the materials i) –iv) described below were sufficiently mixed using a ball mill and then kneaded on a three-role heated to 140° C. After the mixture was allowed to stand for cooling, it was pulverized using a feather mill and further using a jet mill to obtain a toner fine powder. The materials v) and vi) described below were added to the resultant toner fine powder and the toner mixture was mixed using a Henshel mixer to obtain a yellow toner (toner B).

| | |
|---|---|
| i) Polyester resin | 93 parts by weight |
| ii) Dis-azo type pigment | 5 parts by weight |
| iii) Polypropylene type wax | 1 part by weight |
| iv) Charge control agent (quaternary ammonium complex) | 1 part by weight |
| v) External additive (titania) | 1% by weight |
| vi) External additive (silica) | 0.6% by weight |

Example 1

10 kg of the carrier A2 and 200 g of conductive titanium oxide ET300W (manufactured by Ishihara Sangyo Ltd., average particle diameter: 0.03 $\mu$m, L value=78.5) as the second white conductive material were placed in a Henshel mixer with a capacity of 20 little (FM20C/I model, manufactured by Mitsui Miike Chemical Machine Co., Ltd.). Thereafter, hot water was allowed to flow through a jacket formed around the Henshel mixer to raise the temperature (treating temperature) in the Henshel mixer to 70° C. The rotation of the Henshel mixer was adjusted to 400 rpm (head velocity: 5 m/s) to run the Henshel mixer with the temperature being kept at 70° C. The mixture was stirred for one hour to apply conductive titanium oxide ET300W to concave portions formed into the surface of the carrier A2 (see FIGS. 10 and 11). Then, the rotation speed was raised to 1,600 rpm (head velocity: 20 m/s) with the temperature being kept as it was to apply an impact for one hour thereby smoothing the surface of the carrier (see FIGS. 12 and 13).

Next, 200 g of conductive zinc white 23-KC1̂ whose surface was treated hydrophobic (manufactured by Hakusui Kagaku Kogyo Co., Ltd., average particle diameter: 0.4 $\mu$m, the surface is treated using a fluorine-contained silane coupling agent, L value=81.2) was introduced into the Henshel mixer and mixed. Thereafter, the Henshel mixer was allowed to work for 4 hours to apply a mechanical impact, thereby embedding the above 23-KC1̂ in the polyethylene resin layer on the carrier A2 to obtain the polyethylene resin layer excluding 23-KC1̂. Thus, a hydrophobic white conductive material-containing polyethylene resin layer and a surface polyethylene coating layer were formed (see FIGS. 14 and 15). Further, although the amount of the white conductive material which was present in a free state without being fixed was small, screening treatment (#125 mesh) and classification treatment (using a fluidized bed type air classifier, linear velocity: 20 cm, two hours) were performed to remove such a white conductive material to obtain a carrier (carrier B).

Each visual luminosity (L value) of the first and second white conductive materials was measured by a reflectometer (TR-1000D model, manufactured by Tokyo denshokusha Co.).

(1) Observation by an Electron Microscope

The surface of the carrier B (the carrier A2 (FIGS. 8 and 9)) in each of the production stages, that is, after the conductive titanium oxide was added (FIGS. 10 and 11), after being smoothed (FIGS. 12 and 13) and the carrier B itself (FIGS. 14 and 15) was observed using a scanning electron microscope (SEM).

As a consequence, it was confirmed that the condition of conductive titanium oxide added to the concave portion, the condition of progress in smoothing and the condition of uniform dispersion of the conductive zinc white were satisfactory respectively. Specifically, a coating layer is uniformly formed around a carrier core material having concave portions as shown in FIGS. 8 and 9 and the presence of the concave portions is clearly confirmed. Also, as shown in FIGS. 10 and 11, conductive titanium oxide is uniformly filled in the concave portion of the coating layer and the surface of the coating layer is, as shown in FIGS. 12 and 13, uniformly smoothed with the conductive titanium oxide being embedded. Moreover, as shown in FIGS. 14 and 15, the surface of the carrier B on which a surface polyethylene coating layer is formed is remarkably smooth and the carrier B is close to a sphere as a whole.

(2) Charging Characteristics

The charging characteristics of the resultant carrier B were measured under the following conditions: a high temperature and high humidity condition (HH condition, temperature: 33° C., humidity: 85 %), a normal temperature and normal humidity condition (NN condition, temperature: 25° C., humidity: 60 %) and a low temperature and low humidity condition (LL condition, temperature: 10° C., humidity: 35 %). To state in more detail, 10 g of the carrier B and 0.5 g of a color toner (the toner A, magenta) were placed in a 50 ml plastic bottle, allowed to stand in each condition for 48 hours and thereafter charged forcibly by stirring one hour using a ball mill. Then, the carrier B and the toner were taken out of the plastic bottle to measure the charge quantity of the carrier B by using a charge quantity measuring device (TB-200 model, manufactured by Toshiba Chemical Co., Ltd.) in the condition that the blow pressure was 0.8 kg/cm$^2$, the blowing time was 50 seconds and a 500 mesh stainless wire netting was used. The results obtained are shown in Table 1.

(3) Resistance Value

The carrier B was filled between electrodes (area of each electrode: 5 cm$^2$) arranged in a vertical direction and a carrier layer (thickness: 0.5 cm) was formed. Then, a voltage of 1 to 500 V was applied between the vertical electrodes to measure the value of current flowing through the bottom thereby calculating the resistance value of the carrier B. The results obtained are shown in Table 1.

(4) Rate of Change in Water Content 5 g of the carrier B was placed in a 50 ml plastic bottle with a lid being opened and was allowed to stand under a super high temperature and high humidity condition (super HH condition, temperature: 50° C., humidity: 90 %) and a normal temperature and normal humidity condition (NN condition, temperature: 25° C., humidity: 60 %) for 48 hours respectively. Then, a Karl Fischer's method (CA-06 model, vaporizer: VA-06 model, manufactured by Mitsubishi Chemical Co., Ltd.) was used to measure each water content of the carrier in the condition that the temperature was 105° C. and the $N_2$ flow rate was 200 ml/min. Also, when the water content in the super HH condition was designated as Q2 and the water content in the NN condition was designated as Q1, the value of Q1/Q2 was calculated as the rate of change in water content. The results obtained are shown in table 2.

(5) Visual Luminosity (L Value)

The visual luminosity (L value) was measured using a reflectometer (TR-1000D model, manufactured by Tokyo denshokusha). Specifically, the carrier B and a yellow toner (toner B, yellow) were mixed in a ratio by weight of 100:4.5 to prepare a developer. Using this developer, a solid pattern was actually printed by a remodeling machine of Ecosys 3550 (manufactured by Kyocera Corporation) and the visual luminosity (L value) of the resultant solid pattern was measured.

It is to be noted such a visual luminosity is a value calculated by introducing a reflectance Y, obtained using a green filter, into the relational expression $L=10\sqrt{Y}$. It may be said that a yellow image posing no practical problem is obtained when the value of the visual luminosity is 80 or more, a yellow image with almost no dulling is obtained when the value of the visual luminosity is 85 or more and a yellow image with more reduced dulling is obtained when the value of the visual luminosity is 90 or more. The results obtained are shown in Table 3 as the visual luminosity in printing together with the visual luminosity of the first white conductive material used.

(6) Image Density and Overlapping Density

Figure 20:
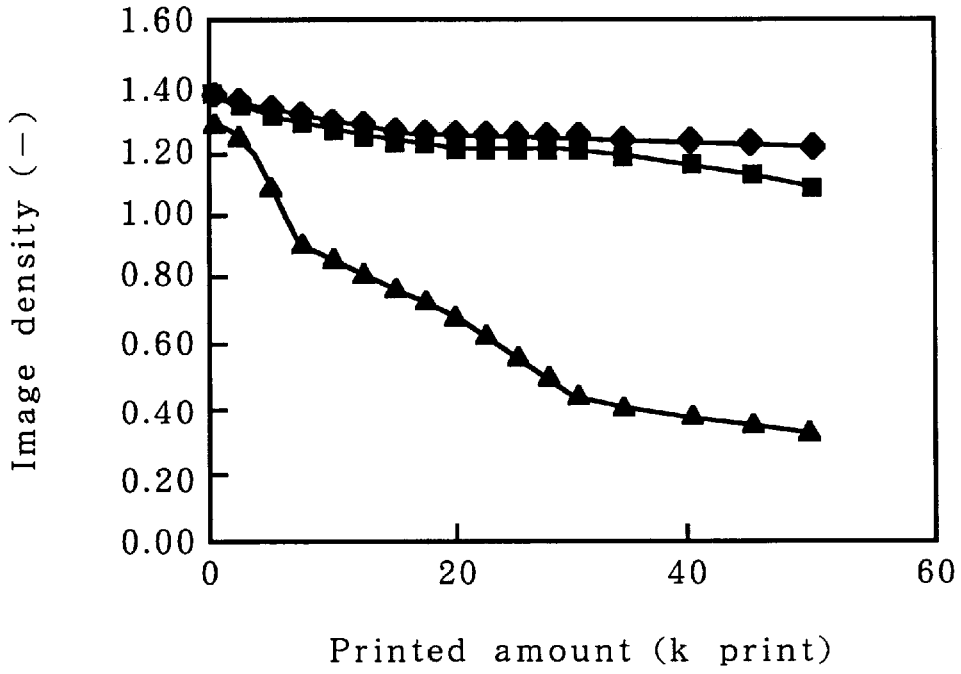
FIG. 20 is a view showing a change in the image density of each of carriers B, E and K.
Figure 21:
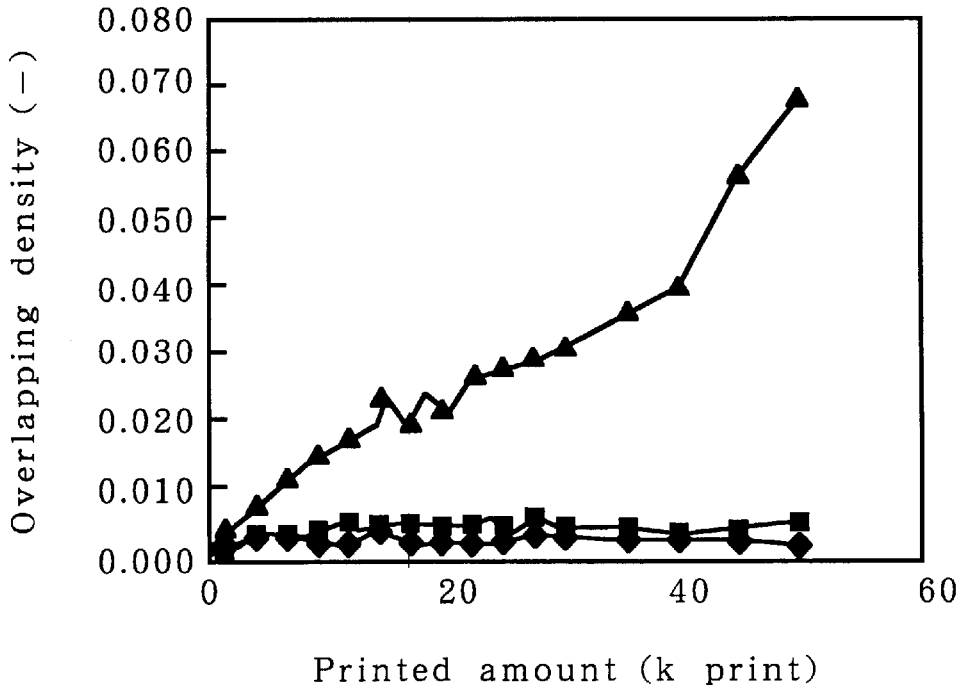
FIG. 21 is a view showing a change in the overlapping density of each of carriers B, E and K.

The carrier B and a color toner (toner A, magenta) were mixed in a ratio by weight of 100:4.5 to prepare a developer. After this developer was placed in the aforementioned remodeling machine of Ecosys 3550 and an ISO test pattern was actually printed off 50,000 copies in total. During this actual printing, a solid pattern was printed every given number of copies and the resultant solid pattern copies were measured for image density and overlapping density by using a Macbeth densitometer. The results obtained are shown in FIGS. 20 and 21. In FIG. 20, the axis of abscissa indicates printed amount (unit: 1,000 copies) and the axis of ordinate indicates image density (–). In FIG. 21, the axis of abscissa likewise indicates printed amount and the axis of ordinate indicates overlapping density (–).

As is clear from the results, with regard to the developer including the carrier B, a reduction in the image density of the solid pattern is of the order of 10 % after 50,000 sheets were copied and the overlapping density is not almost increased. Therefore it may said that the developer containing the carrier B has an excellent durability and charging characteristics.

Example 2

A carrier (carrier C) was obtained in the same manner as in Example 1 except that ET300W as the second white conductive material was altered to hydrophobically treated-conductive zinc white 23-KĈ1 (manufactured by Hakusui Kagaku Kogyo Co., Ltd., average particle diameter: 0.4 $\mu$m, the surface was treated using a fluorine-containing silane coupling agent). The resultant carrier C was evaluated for the charging characteristics and the like (excluding the measurements of image density and overlapping density) in the same manner as in Example 1.

Example 3

A carrier (carrier D) was obtained in the same manner as in Example 1 except that the conductive titanium oxide ET300W as the second white conductive material was altered to hydrophobically treated-conductive zinc white 23-KĈ1 (manufactured by Hakusui Kagaku Kogyo Co., Ltd., average particle diameter: 0.4 $\mu$m, the surface was treated using a fluorine-containing silane coupling agent, L value=81.2) and 23-KĈ1 as the first white conductive material was altered to surface hydrophobically treated-conductive titanium oxide ET502W (manufactured by Ishihara Sangyo Kaisha Ltd., average particle diameter: 0.4 $\mu$m, the surface was treated using an alkyl type silane coupling agent, L value =79.5). The resultant carrier D was evaluated for the charging characteristics and the like (excluding the measurements of image density and overlapping density) in the same manner as in Example 1.

Example 4

10 kg of the carrier A2 was placed in a Henshel mixer with a capacity of 20 little (FM20C/I model, manufactured by Mitsui Miiuke Chemical Machine Co., Ltd.). Thereafter, hot water was allowed to flow through a jacket formed around the Henshel mixer to raise the temperature (treating temperature) in the Henshel mixer to 70° C. The rotation of the Henshel mixer was adjusted to 1,600 rpm (head velocity: 20 m/s) to run the Henshel mixer with the temperature being kept at 70° C. The mixture was stirred for one hour to smooth the surface of the carrier A2. Thereafter, keeping that temperature, 360 g of 23-KĈ1 as the first white conductive material was added and stirring was further performed at the same rotation for 3 hours to introduce 23-KĈ1 into the high molecular weight polyethylene coating (first stage). Incidentally, it was confirmed by a scanning electron microscope that no 23-KĈ1 was present in the vicinity of the surface (FIGS. 16 and 17).

Next, because the resistance was insufficiently controlled in this condition, cooling water was allowed to flow through the jacket formed around the Henshel mixer to drop the temperature (treating temperature) of the inside of the Henshel mixer to 35° C. Then, 200 g of 23-KĈ1 as the first white conductive material was added again, followed by stirring at the same rotation for two hours to add 23-KĈ1 to the vicinity of the surface (second stage).

Further, although the amount of the white conductive material which was present in a free state without being fixed was small, screening treatment (#125 mesh) and classification treatment (using a fluidized bed type air classifier, linear velocity: 20 cm, two hours) were performed to remove such a white conductive material to obtain a carrier (carrier E). The resultant carrier E was evaluated for the charging characteristics and the like (excluding the measurements of image density and overlapping density) in the same manner as in Example 1.

(1) Observation by an Electron Microscope

The surface of the carrier E was observed using a scanning electron microscope (SEM) (FIGS. 18 and 19). As a consequence, it was confirmed that conductive zinc white whose surface is hydrophobically treated was fixed as a conductive layer in the inside of the high molecular weight polyethylene coating and hydrophobically treated-conductive zinc white was uniformly dispersed in the vicinity of the surface by the subsequent mechanical impact. Specifically, like the carrier E, the hydrophobic white conductive material was first added in the inside in a large amount and further in a less amount in the vicinity of the surface in two stages (first and second stages) whereby the resistance was controlled more easily. It was also confirmed that, as shown in FIG. 18, the surface of the carrier E was remarkably smooth and the carrier E was close to a sphere as a whole.

(2)–(6) Charging Characteristics and the Like

The charging characteristics and the like of the carrier E were evaluated in the same manner as in Example 1.

(7) Measurement by Auger Electron Spectroscope

With regard to the carrier E, an analysis in the direction of the thickness concerning the positioning of the conductive zinc white in the coating resin was made using an Auger electron spectroscope (JAMP-7100 model, manufactured by JEOL Ltd. ). Specifically, $Ar^+$ sputtering treatment and an analysis of a Zn element (primary element of conductive zinc white) were repeated and the conversion of the depth was made using $Ar^+$ sputtering time as a standard.

As a consequence, a maximum peak value in terms of the intensity of Zn was detected at the position 0.6 $\mu$m below the surface. It was therefore confirmed that a conductive layer comprising conductive zinc white was formed at the position 0.6 $\mu$m below the surface.

Example 5

A carrier (carrier F) was obtained in the same manner as in Example 1 except that 23-KĈ1 used as the first white conductive material was altered to conductive zinc white 23-KC2̂ ) whose surface was hydrophobically treated (manufactured by Hakusui Kagaku Kogyo Co., Ltd., average particle diameter: 0.4 μm, the surface was treated using an alkyl type silane coupling agent, L value =81.5). The charging characteristics and the like (excluding the measurements of image density and overlapping density) of the resultant carrier F were evaluated in the same manner as in Example 1.

Example 6

10 kg of the carrier A4 was placed in a Henshel mixer with a capacity of 20 little (FM20C/I model, manufactured by Mitsui Miike Chemical Machine Co., Ltd.). Thereafter, hot water was allowed to flow through a jacket formed around the Henshel mixer to raise the temperature (treating temperature) in the Henshel mixer to 70° C. The rotation of the Henshel mixer was adjusted to 1600 rpm (head velocity: 20 m/s) to run the Henshel mixer with the temperature being kept at 70° C. The mixture was stirred for one hour to smooth the surface of the carrier A4. Thereafter, keeping that temperature, 200 g of 23-KC1̂ as the first white conductive material was added and stirring was further made at the same rotation for 2 hours to introduce 23-KC1̂ into the high molecular weight polyethylene coating.

Further, although the amount of the white conductive material which was present in a free state without being fixed was small, screening treatment (#125 mesh) and classification treatment (using a fluidized bed type air classifier, linear velocity: 20 cm, two hours) were performed to remove such a white conductive material to obtain a carrier (carrier G). The resultant carrier G was evaluated for the charging characteristics and the like (excluding the measurements of image density and overlapping density) in the same manner as in Example 1.

Example 7

A carrier (carrier H) was obtained in the same manner as in Example 1 except that the amount of ET300W used as the second white conductive material was changed from 200 g to 140 g. The charging characteristics and the like (excluding the measurements of image density and overlapping density) of the resultant carrier H were evaluated in the same manner as in Example 1.

Comparative Example 1

The carrier A6 obtained in the production 3 of a carrier coated with polyethylene was used as it was to evaluate the charging characteristics and the like (excluding the measurements of image density and overlapping density) in the same manner as in Example 1.

Comparative Example 2

A carrier (carrier I) was obtained in the same manner as in Example 1 except that 23-KC1̂ used as the first white conductive material was altered to conductive zinc white 23-KA (manufactured by Hakusui Kagaku Kogyo Co., Ltd., average particle diameter: 0.4 μm, L value =55). The charging characteristics and the like (excluding the measurements of image density and overlapping density) of the resultant carrier I were evaluated in the same manner as in Example 1.

Comparative Example 3

A carrier (carrier K) was obtained in the same manner as in Example 6 except that only smoothing treatment was performed at 70° C. for 2 hours without adding 23-KC1̂ used as the first white conductive material at all. The charging characteristics and the like of the resultant carrier K were evaluated in the same manner as in Example 1.

An analysis in the direction of the thickness concerning the positioning of the conductive zinc white in the coating resin was made using an Auger electron spectroscope (JAMP-7100 model, manufactured by JEOL Ltd.). As a consequence, a maximum peak value in terms of the intensity of Zn was detected at the position 1.9 μm below the surface.

TABLE 1

| | Carrier | Charge quantity (μC/g) LL condition | NN condition | HH condition | Resistance (Ωcm) |
|---|---|---|---|---|---|
| Example 1 | B | +16.3 | +15.6 | +15.4 | $3 \times 10^{10}$ |
| Example 2 | C | +19.6 | +19.2 | +18.7 | $7 \times 10^{11}$ |
| Example 3 | D | +10.9 | +10.8 | +10.3 | $2 \times 10^{12}$ |
| Example 4 | E | +15.2 | +14.9 | +14.7 | $7 \times 10^{12}$ |
| Example 5 | F | +12.7 | +12.3 | +11.6 | $1 \times 10^{9}$ |
| Example 6 | G | +14.4 | +13.7 | +13.1 | $6 \times 10^{12}$ |
| Example 7 | H | +16.1 | +15.5 | +15.4 | $2 \times 10^{12}$ |
| Comparative Example 1 | A6 | +2.4 | +2.2 | −0.2 | $5 \times 10^{10}$ |
| Comparative Example 2 | I | +9.8 | +9.2 | +8.4 | $7 \times 10^{8}$ |
| Comparative Example 3 | K | +3.8 | +2.9 | −0.8 | $8 \times 10^{12}$ |

TABLE 2

| | Carrier | Water content at NN condition Q1 (ppm) | Water content at HH condition Q2 (ppm) | Rate of change Q1/Q2 |
|---|---|---|---|---|
| Example 1 | B | 138 | 152 | 0.908 |
| Example 2 | C | 140 | 158 | 0.886 |
| Example 3 | D | 155 | 186 | 0.833 |
| Example 4 | E | 166 | 177 | 0.938 |
| Example 5 | F | 142 | 182 | 0.780 |
| Example 6 | G | 144 | 161 | 0.894 |
| Example 7 | H | 135 | 148 | 0.912 |
| Comparative Example 1 | A6 | 240 | 367 | 0.654 |
| Comparative Example 2 | I | 160 | 221 | 0.849 |
| Comparative Example 3 | K | 110 | 159 | 0.692 |

TABLE 3

| | Carrier | Visual luminosity of first white conductive material (L value) | Visual luminosity in printing (L value) |
|---|---|---|---|
| Example 1 | B | 81.2 | 90.2 |
| Example 2 | C | 81.2 | 89.6 |
| Example 3 | D | 79.5 | 90.1 |
| Example 4 | E | 81.2 | 91.6 |
| Example 5 | F | 81.5 | 88.7 |
| Example 6 | G | 81.2 | 90.3 |
| Example 7 | H | 81.2 | 92.1 |
| Comparative Example 1 | A6 | — | 76.6 |
| Comparative Example 2 | I | 55 | 78.3 |
| Comparative Example 3 | K | — | 91.2 |

EFFECT OF THE INVENTION

The present invention enables it possible to provide an electrophotographic carrier which has high charging characteristics and an excellent durability, does not dull a color image even if it is used in a color printer or the like and has an excellent moisture resistance, a process for the production of the carrier and a developing agent for electrophotography using the carrier.

What is claimed is:

1. An electrophotographic carrier comprising a magnetic carrier core material and a coating layer formed on a surface of the carrier core material, wherein the coating layer comprises at least:

a high molecular weight polyethylene resin of 10,000 or more in terms of number average molecular weight as measured by GPC, and a hydrophobic white conductive material having a visual luminosity L measured by a reflectometer of 78 or more.

2. An electrophotographic carrier comprising a magnetic carrier core material and a coating layer formed on a surface of the carrier core material, wherein the coating layer comprises at least a high molecular weight polyethylene resin of 10,000 or more in terms of number average molecular weight as measured by GPC and a hydrophobic white conductive material, and wherein the ratio Q1/Q2is 0.75 or more where the water content of said electrophotographic carrier after being allowed to stand at a temperature of 20° C. and a humidity of 50 % for 48 hours is designated as Q1 and the water content of said electrophotographic carrier after being allowed to stand at a temperature of 50° C. and a humidity of 90 % for 48 hours is designated as Q2.

3. An electrophotographic carrier comprising a magnetic carrier core material and a coating layer formed on a surface of the carrier core material, wherein the coating layer comprises at least a high molecular weight polyethylene resin of 10,000 or more in terms of number average molecular weight as measured by GPC and a first hydrophobic white conductive material, and wherein a concave portion formed in said coating layer is filled with one or both of a second hydrophobic white conductive material differing from said first hydrophobic white conductive material and a hydrophilic white conductive material.

4. An electrophotographic carrier comprising a magnetic carrier core material and a coating layer formed on a surface of the carrier core material, wherein the coating layer comprises at least a high molecular weight polyethylene resin of 10,000 or more in terms of number average molecular weight as measured by GPC and a first hydrophobic white conductive material, and wherein there is formed inside of said coating layer a conductive layer of one or both of a second hydrophobic white conductive material differing from said first hydrophobic white conductive material and a hydrophilic white conductive material, the thickness of the conductive layer being in a range of 0.5 to 3 $\mu$m.

5. An electrophotographic developer comprising an electrophotographic carrier and a toner, said electrophotographic carrier comprising a carrier core material provided with magnetism and a coating layer formed on a surface of the carrier core material, wherein the coating layer comprises at least a high molecular weight polyethylene resin of 10,000 or more in terms of number average molecular weight as measured by GPC and a hydrophobic white conductive material having a visual luminosity L measured by a reflectometer of 78 or more, further wherein the amount of the toner is in a range of 2 to 40 % by weight based on the total amount of said electrophotographic carrier and toner.

6. An electrophotographic developer comprising an electrophotographic carrier and a toner, said electrophotographic carrier comprising a carrier core material provided with magnetism and a coating layer formed on a surface of the carrier core material, wherein the coating layer comprises at least a high molecular weight polyethylene resin of 10,000 or more in terms of number average molecular weight as measured by GPC and a hydrophobic white conductive material, and wherein the ratio Q1/Q2 is 0.75 or more where that the water content of said electrophotographic carrier after being allowed to stand at a temperature of 20° C. and a humidity of 50 % for 48 hours is designated as Q1 and the water content of said electrophotographic carrier after being allowed to stand at a temperature of 50° C. and a humidity of 90 % for 48 hours is designated as Q2, further wherein the amount of the toner is in a range of 2 to 40 % by weight based on the total amount of said electrophotographic carrier and toner.

7. An electrophotographic developer comprising an electrophotographic carrier and a toner, said electrophotographic carrier comprising a carrier core material provided with magnetism and a coating layer formed on a surface of the carrier core material, wherein the coating layer comprises at least a high molecular weight polyethylene resin of 10,000 or more in terms of number average molecular weight as measured by GPC and a first hydrophobic white conductive material, a concave portion formed in said coating layer is filled with one or both of a second hydrophobic white conductive material and a hydrophilic white conductive material, and the amount of the toner is in a range of 2 to 40 % by weight based on the total amount of said electrophotographic carrier and toner.

8. An electrophotographic developer comprising an electrophotographic carrier and a toner, said electrophotographic carrier comprising a carrier core material provided with magnetism and a coating layer formed on a surface of the carrier core material, wherein the coating layer comprises at least a high molecular weight polyethylene resin of 10,000 or more in terms of number average molecular weight as measured by GPC and a first hydrophobic white conductive material, and wherein there is formed inside of said coating layer a conductive layer of one or both of a second hydrophobic white conductive material differing from said first hydrophobic white conductive material and a hydrophilic white conductive material, the conductive layer having a thickness in a range of 0.5 to 3 mm, and wherein the amount of toner is in a range of 2 to 40 % by weight based on the total amount of said electrophotographic carrier and toner.

* * * * *